United States Patent [19]

Elluin et al.

[11] Patent Number: 4,919,327

[45] Date of Patent: Apr. 24, 1990

[54] AIR-PROCESSING INSTALLATION DESIGNED FOR THE VENTILATION AND AIR-CONDITIONING OF SEVERAL ROOMS AND AIR-PROCESSING MODULE DESIGNED FOR AN INSTALLATION OF THIS TYPE

[75] Inventors: Patrice Elluin, Paris; Pascal Verrecchia, Les Lilas; Georges Mauer, Evreux; Philippe Cardon, La Boissiere-Ecole, all of France

[73] Assignee: Societe D'Administration Et De Realisations D'Investissements (SARI), Paris, France

[21] Appl. No.: 216,301

[22] Filed: Jul. 7, 1988

[30] Foreign Application Priority Data

Jul. 10, 1987 [FR] France ..... 87 09630

[51] Int. Cl.[5] ..... F24F 7/00

[52] U.S. Cl. ..... 236/49.1; 62/265; 165/53; 165/76

[58] Field of Search ..... 236/49 D, 49 C, 49 R, 236/51; 165/16, 22; 98/34.6; 62/265, DIG. 6

[56] References Cited

U.S. PATENT DOCUMENTS

| | | | |
|---|---|---|---|
| 2,333,309 | 11/1943 | Gould | 62/DIG. 16 |
| 3,404,618 | 10/1968 | Jacobs | 98/34.6 |
| 3,949,809 | 4/1976 | Gilles | 98/34.6 X |
| 4,078,395 | 3/1978 | Crowe et al. | 62/265 X |
| 4,118,083 | 10/1978 | Lackey et al. | 62/DIG. 16 |

*Primary Examiner*—William E. Wayner

[57] ABSTRACT

An air-processing installation designed to ventilate and air-condition several rooms, as well as an air-processing module designed for the making of an installation of this type are disclosed. With each room to be air-conditioned, there is associated a structurally and functionally independent air-processing module housed in an engine room common to the different air-processing modules and remote controlled, independently of the other air-processing modules, from the associated room. Preferably, the modules are suspended in a mutually juxtaposed state in the engine room. An installation of this type reconciles requirements of hygiene and comfort with easy maintenance while at the same time, occupying the minimum amount of space.

92 Claims, 4 Drawing Sheets

AIR-PROCESSING INSTALLATION DESIGNED FOR THE VENTILATION AND AIR-CONDITIONING OF SEVERAL ROOMS AND AIR-PROCESSING MODULE DESIGNED FOR AN INSTALLATION OF THIS TYPE

BACKGROUND OF THE INVENTION

1. Field of the Invention

The present invention relates to an air-processing installation, designed for the ventilation and air-conditioning of several rooms and to an air-processing module designed for the making of an installation of this type.

2. Description of the Prior Art

Conventionally, when it is desired to ventilate and air-condition several rooms, there is a choice between two types of installation.

A first type of installation has a single air-processing plant which is housed in an engine room and provides supply, in parallel, to air blowing openings placed in the different rooms through a system of branching conduits. The single air-processing plant, which is partially supplied with fresh air, also recovers in air from each room through another system of branching conduits ending in air suction openings placed in the different rooms.

The disadvantage of a known installation of this type is that it is very difficult and even impossible to adapt the ventilation and air-conditioning to the specific needs of each room. Thus, for example, it is practically impossible to find a setting of the air-conditioning plant which will give the ventilation and air-conditioning needed for a sick room, an office and a computer room which, however, may be adjacent rooms.

Furthermore, a known installation of this type implies a mixing of the stale air coming from the different rooms and then a re-introduction of this mixed air (mixed, it is true, with fresh air) into the different rooms. In other words, the air taken from one room is then distributed among the other rooms, and if this air is charged with fumes, microbes or viruses, these fumes, microbes or viruses are distributed in the other rooms to the detriment of the comfort and health of their occupants.

Finally, a known installation of this type has the disadvantage of requiring the installation of a complex system of branching conduits implying the presence of numerous connections and variations in diameter as well as difficulties related to intersection with other systems such as systems for water, gas and electrical supply, and the disadvantage entailed by the fact that any breakdown or maintenance operation in the air-processing plant might cause an interruption in ventilation and air-conditioning in all the rooms concerned.

An installation of the second type copes with these drawbacks inasmuch as, in this installation, each room has its own convection fan which takes air only from this room, apart from a supply of fresh air, and blows air only into this room. This approach is a hygienic one and can be adjusted with great flexibility to the specific ventilation and air-conditioning needs of the room considered. Furthermore, it enables doing necessarily means that it must be placed on the outside wall of the building, which partly limits possibilities of layout and practically rules out the possibility of setting it up in rooms that do not adjoin an outside wall. Furthermore, inasmuch as for each room, there is a corresponding a fresh air tap, it spoils the general aesthetic quality of buildings fitted with it and limits the possibilities of choice as regards this aesthetic appearance. Furthermore, an individual supply of each convection fan with fresh air through a fresh air tap on the outside wall prevents any effective control over the flowrate of fresh air given by the convection fans since this flowrate is closely related to atmospheric conditions and, more precisely, to wind. To cope with these disadvantages, this individual supply of fresh air to each convection fan is sometimes replaced by a supply to the various rooms from an air-processing plant connected to these various rooms by a system of conduits, with regulation of flowrate and temperature of this fresh air. In this case, however, several disadvantages indicated earlier for an installation of the first type, reappear.

Furthermore, when the desired temperature setting of the air travelling through each convection fan of an installation of the second type implies a thermal exchange with a heat-exchanging fluid, as is usual with convection fans used for cooling air and as is frequent with convection fans used for heating air, it is necessary to provide for a complicated and expensive system for the supply of heat-exchanging fluid, which is difficult to maintain. And moreover, a condensate discharging system is needed for reasons of hygiene, and has the same disadvantages.

Finally, the second type of installation requires maintenance personnel to take action in each room under conditions that are often uncomfortable whether the convection fan is placed on a shoulder or in a false ceiling. Sometimes, even the maintenance operations can make the room unusable for a time, as is the case for certain hospital rooms. This is also true for possible leakages of heat-exchanging fluid or condensates which may furthermore cause damage to equipment in the rooms in which they occur.

SUMMARY OF THE INVENTION

The present invention proposes an air-processing installation used to cope with all these disadvantages.

To this effect, the invention proposes an air-processing installation, designed for the ventilation and air-conditioning of several rooms, and comprising, to this effect, air-processing means housed in an engine room, at least one air blowing opening and at least one air suction opening in each room and connection conduits for the said air blowing and air suction openings to the air-processing means, wherein said air processing means comprise air treatment modules grouped together in said engine room and wherein each module is associated with a respective room and comprises, independently of the other air-processing modules:

an air suction connector connected by a respective conduit to the air suction opening of the respectively associated room, an air blowing connector connected to the air blowing opening of the room respectively associated with a respective conduit, an internal air circuit connecting said air suction and air blowing connectors to each other, ventilation and air-conditioning means interposed in said internal air circuit, rooms for connecting the ventilation and air-conditioning means to power supply means, adjustable means to regulate the ventilation and air-conditioning means at least as regards air temperature, and wherein furthermore there are provided respective means for the remote control of the adjustable means for the regulation of the ventilation and air-conditioning means of each air-processing module from the respectively associated room.

It will easily be seen that the air taken from each room can be re-injected only into this room, at a temperature and a flowrate which are set directly and individually by the occupant of this room, as the case may be within the limits laid down by centralized technical management means, so much so that the system both meets the most stringent hygienic conditions and provides the most best possibility of being adapted, at every instant, to the specific ventilation and air-conditioning needs of each room. The user comfort of the installation is further increased if, as preferred, each air blowing opening has a thermostatic flap to direct the blown air as a function of the blowing temperature in a manner known per se.

Furthermore, a breakdown in an air-processing module or maintenance action on this module does not cause any interruption in ventilation and air-conditioning except in the respectively associated room, and causes this interruption for a period which may be considerably shortened since it is possible to design the air-processing modules and place them in the engineering room in such a way that the maintenance operations are made easier independently of all aesthetic considerations and all imperatives concerning layout in an inhabited room. However, each module designed to ventilate and air-condition a single room may occupy a space which is small enough for it to be easily and swiftly changed in case of damage.

The condensates are formed only in the engine room. Their removal does not call for any network through the different rooms, and can be done very simply by recovery through a collecting conduit common to all the convection fans and restricted to the engine room, or more simply, through free flowing by gravity up to a siphon built into the floor of the engine room. Any leakages of condensates and the stagnation of these condensates are limited to the engine room and do not affect the hygiene of the rooms, a factor that is especially important in certain instances as, for example, in hospital rooms.

Furthermore, most of the maintenance or repair operations require action only in the engine room. This makes periodic maintenance operations such as, for example, the changing of filters, much faster, and, furthermore, makes it possible to perform these operations without affecting the possibility of using the rooms. Similarly, when the ventilation and air-conditioning means imply a heat change of air with a heat-exchanging fluid, any leakages of this liquid are limited to the engine room. In other words, they have no effect on the use of the rooms and are without risk for the equipment in these rooms, and their repair implies action only in this engine room.

Finally, the design of an installation of this type makes it possible to totally eliminate branching connections or changes in the diameter of the conduits, i.e. it simplifies their making and layout. All the conduits can have the same constant diameter from one end to the other. This diameter, which is adapted to the flowrate corresponding to a single room, may be relatively small so much so that, despite the number of conduits, their intersection with the conduits or electrical cables raises no difficulty even for passages such as low false ceilings. The possibility of using conduits of constant diameter, of any desired length, also results in an appreciable saving.

Preferably, the air processing modules are identical and only their adjustment is individualized so that they can be easily and quickly interchanged in case of damage.

According to a preferred embodiment of the present invention, each air-processing module is bounded externally by two mutually parallel, flat, lateral faces and by peripheral faces which connect said lateral faces to each other and group the supporting means of said module, said air suction and air blowing connectors, said connection means to said energy supply means, access means to said ventilation and air-conditioning means and access means to said adjustable regulation means in the preferred example where the latter are borne by their respective modules. Through this arrangement, the air-processing modules can be grouped in one low-volume battery inside the engine room while, at the same time, providing optimum possibilities of access with a view to maintenance and repairs. It is especially easy to replace a damaged module by another one, if need be, when, in addition, the supporting means of the different modules are independent of each other and capable of enabling each module to be separated from the other ones by a shift along directions parallel to said flat lateral faces.

Preferably, these flat, lateral faces are vertical and the modules are mutually juxtaposed horizontally, thus providing for easier connection of the ventilation and air-conditioning means to the power supply means placed horizontally, parallel to the battery of juxtaposed modules.

Furthermore, in this case, the supporting means of each module may advantageously comprise means for the suspension of this module, each module being suspended in a zone of the engine room ceiling. Thus the battery of juxtaposed modules occupies no space on the floor and the modules can be placed at shoulder height, namely in a position that makes them especially accessible to maintenance operations. According to a preferred embodiment, the suspension means for each module are located in an upper peripheral zone of the said module, vertical to the center of gravity of this module, and have vibration damping means by which the transmission of vibrations to the ceiling of the engine room can be limited to the maximum extent. Furthermore, through a suitable choice of suspension means, the localized suspension system makes it easier to replace one module by another.

When the modules are thus suspended, an optimum arrangement is obtained inside the engine room by seeing to it that, in this engine room, the conduits are arranged in the said ceiling zone, that the air suction and blowing connectors of each module are turned upwards and that the internal air circuit of each module has a U shape between said air suction connections and air blowing connections of this module.

This arrangement is easily compatible with the passage of conduits in the false ceiling towards the air-blowing and air-suction openings of the various rooms. Furthermore, a minimum bulk is got for each module. An advantageous positioning, in each module, of the ventilation and air-conditioning means on the U-shaped circuit thus defined, can also contribute to reducing the bulk of each module. Thus, in a preferred way:

the ventilation and air-conditioning means for each module have a horizontal or vertical filter respectively, and said internal circuit has an inlet plenum chamber between said filter and the respective air suction connector. The ability to interchange the filter, which is a frequent maintenance operation, is especially easy if, in a preferred embodiment, each module has detachable means to receive the respectively associated filter, a lower hatch for mounting and dismounting the filter, on a lower peripheral face of said module and a lower detachable lid to close said lower hatch;

the ventilation and air-conditioning means of each module have at least one respective heat exchanger, respectively vertical or horizontal and juxtaposed horizontally with said respective filter, and said internal circuit has an output plenum chamber between said heat exchanger and the respective air-blowing connector. For example, said heat exchanger of each module is of a heat-exchanging fluid circulation type, the energy supply means have an inlet piping for heat-exchanging fluid and a return piping for heat-exchanging fluid common to all the air-processing modules and the connection means to connect the ventilation and air-conditioning means of each module to energy supply means comprise two respective tubes to convey said heat-exchanging fluid, respectively connected to said inlet piping and to the return piping and placed so as to face a peripheral face of said module and a respective adjusting valve placed in one of said tubes, facing a front peripheral face of said module and connected to said respective adjustable regulation means. The valve is thus easily accessible for adjusting and maintenance operations. Naturally, the term heat exchanger refers both to an air-heating exchanger and to an air-cooling exchanger or, again, to a combination of two of these exchangers, it being understood that an air heating exchanger of the heat-exchanging fluid circulation type may also be replaced by heating electric resistors;

the ventilation and air-conditioning means of each module have a respective motor fan adjoining the respective air blowing connector, and each module has means for mounting and dismounting the motor fan accessible through a front peripheral face adjoining the respective air blowing connector. Maintenance operations on the motor fan are thus easily performed.

Preferably, the motor fan is of a variable speed type connected to respective adjustable regulation means to permit adaptation to the flowrate of the air which flows through each air-processing module and is then blown into the respective room depending on the temperature regulation.

According to another preferred method of implementation, especially when it is designed for the ventilation and air-conditioning of dwelling rooms, the installation of the invention has means to supply the air-processing modules with fresh air.

Naturally, once all the air-processing modules are brought together in one and the same engine room, it is preferably provided that the fresh air supply means have a fresh air piping common to all the air-processing modules and that, for each module, there are respective means to connect the respective air suction connector with the said fresh air piping. The said connecting means have fresh air flowrate regulating means. As an alternative, the internal air circuit of each module can also be connected to the fresh air piping by respective linking means separate from said air suction connector but located, like it, on the peripheral face of the module and comprising respective fresh air flowrate regulating means integrated into the module itself. The fresh air flowrate regulating means may be independent or may be advantageously controlled by adjustable regulation means proper to the corresponding air-processing module respectively. The fresh air piping system advantageously travels through a zone of the engine room ceiling parallel to the battery of juxtaposed air-processing modules, thus giving a rational and compact arrangement.

Preferably, the conduits inside the engine room and the means for connecting the ventilation and air-conditioning means to the energy supply means are flexible at least locally, thus enabling an air-processing module to be shifted with respective to the others without its being necessary to take action beforehand to detach it from the conduits and from said connection means, namely, making it possible to remove the need for direct access to these means when the modules are juxtaposed and to arrange the modules as close as possible to the ceiling of the engine room when they are suspended according to the above-mentioned preferred method of implementation of the invention Furthermore, this helps prevent the transmission of vibrations from a module to the ceiling of the engine room. Thus, installation according to the present invention stays particularly silent and discreet.

BRIEF DESCRIPTION OF THE DRAWINGS

Other features and advantages of the invention will emerge from the following description of a non-restrictive example of implementation as well as from the appended drawings which are an integral part of this description. Of these drawings, FIG. 1 gives a schematic view of a drawing of a layout plan of an air-processing installation according to the present invention.

DESCRIPTION OF A PREFERRED EMBODIMENT

Figure 1:
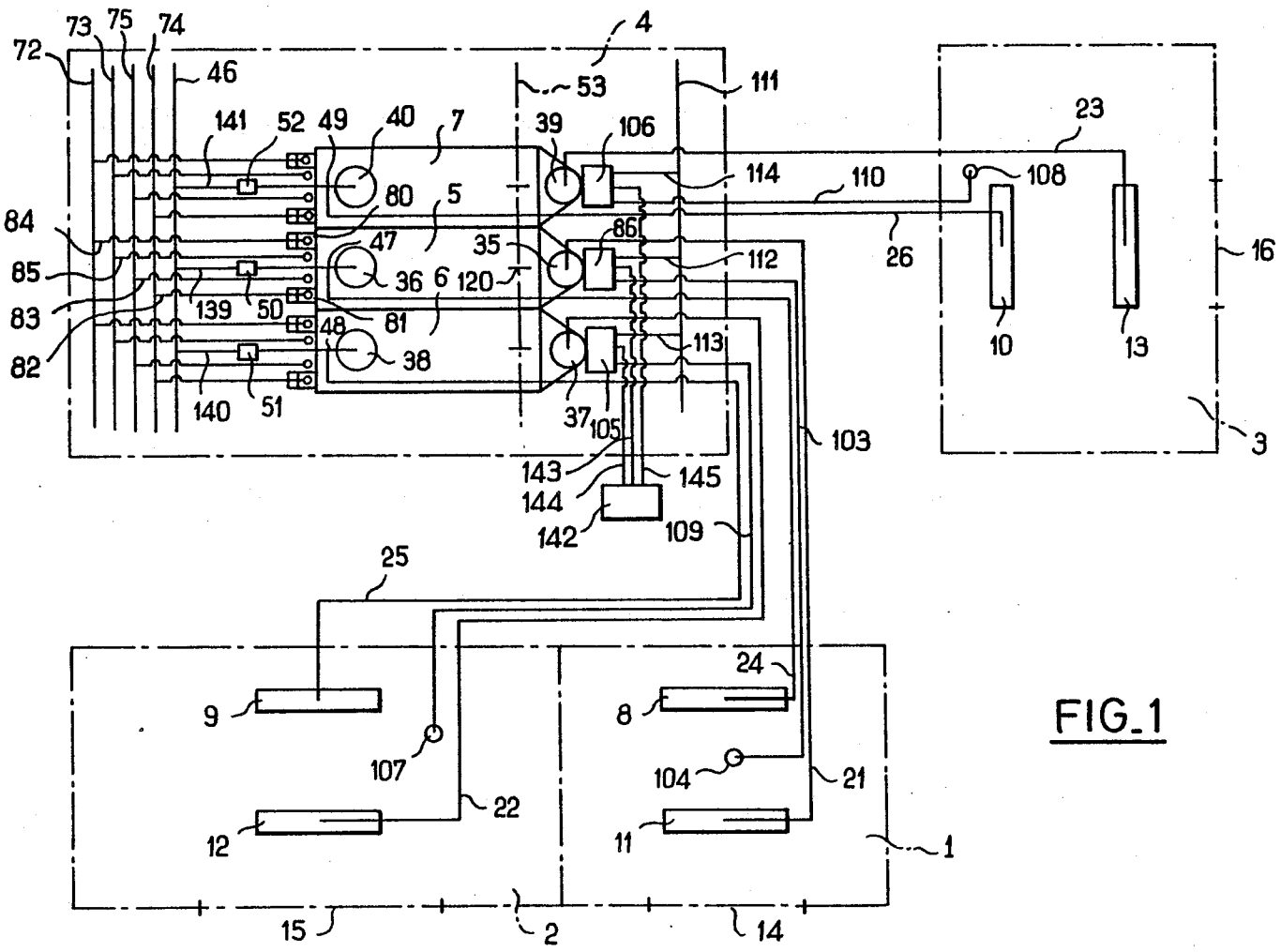

We shall refer firstly to FIG. 1 which schematically illustrates three rooms 1, 2, 3 to be ventilated and air-conditioned and an engine room 4 in which are grouped the air-processing modules 5, 6, 7, respectively associated with these three rooms 1, 2, 3. Naturally, this example is in no way restrictive and the number of rooms that can be air-conditioned from a single engine room, namely the number of air-processing modules grouped together in this engine room will be generally greater than three, a single engine room being provided, for example, to bring together the air-processing modules corresponding to all the rooms of one and the same floor of a building.

Each of the 1, 2, 3, is advantageously provided, in a form that is incorporated in a false ceiling, with at least one air suction or recovery opening 8, 9, 10, and at least one air blowing opening 11, 12, 13, the choice and optimum relative arrangement of which are within the scope of the normal abilities in those skilled in the art. Preferably, when the room 1, 2, 3 is provided with a window, 14, 15, 16, the air blowing opening 11, 12, 13, is placed between the air suction opening 8, 9, 10 and this window 14, 15, 16, and chosen to be of a type comprising a thermostatic flap to orient blown air driven by the blowing temperature as illustrated, for example, with respect to the air blowing opening 11 in FIG. 5 to which we shall now refer.

Figure 5:
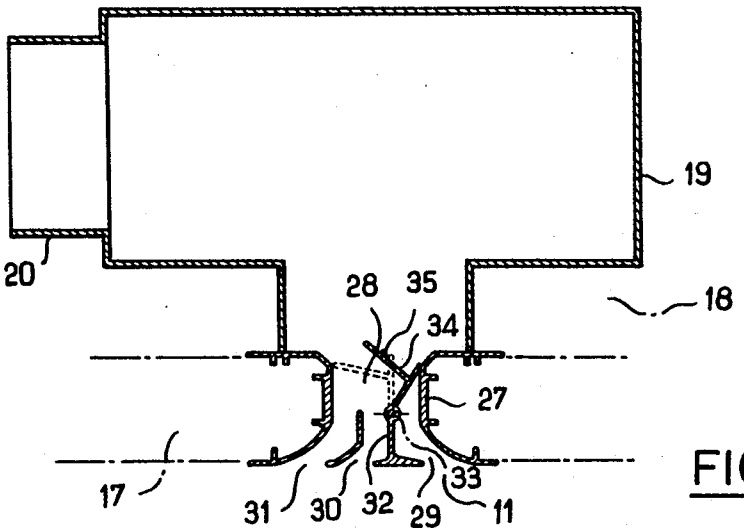
FIG. 5 shows a sectional view in a vertical plane of a preferred type of air-blowing opening supposed to be implanted on a false ceiling.
Figure 3:
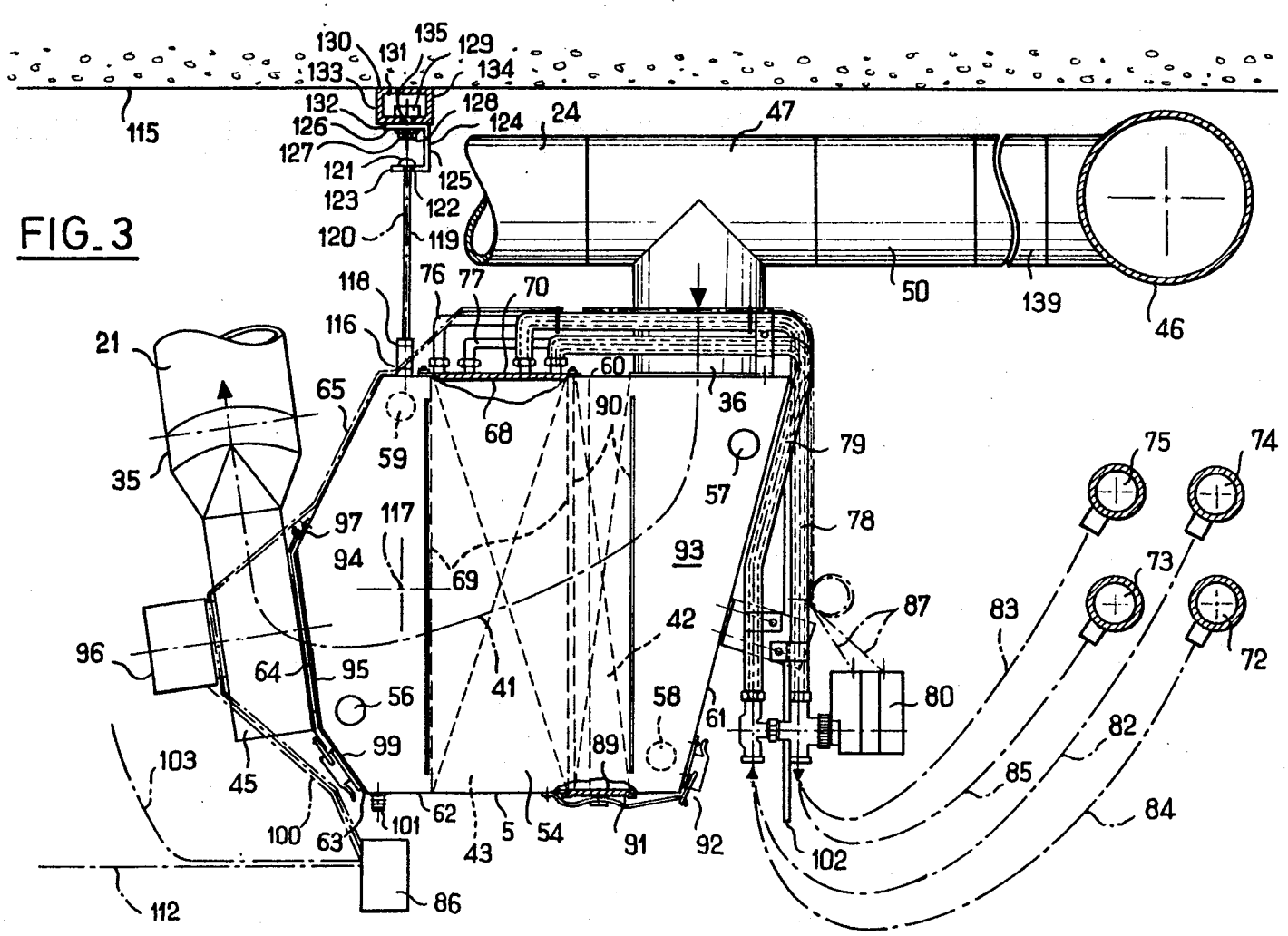
FIG. 3 gives a view in a lateral elevation in the direction of the arrow 3 of FIG. 2 of the same module as it appears, when suspended, in a battery of juxtaposed modules of this type in operation.

FIG. 5 shows a schematic view of a horizontal false ceiling 7 which leaves above it, namely between it and a slab of the ceiling (not shown) an intermediate space 18 in which there is placed, above the air blowing opening 11, an air inlet chamber 19 comprising a connector 20 for a air conveying conduit 21 (also shown in FIGS. 1 and 3). Naturally, in a manner not shown, there is a chamber of this type associated with each of the other air blowing openings 12, 13, said chamber being used to connect an air conveying conduit 22, 23 respectively. Similarly, with each air suction opening 8, 9, 10, there is associated a similar chamber used to connect an air conveying conduit 24 (also visible in FIGS. 1 and 3) 25, 26, respectively. Preferably, each of these conduit connecting chambers is provided with internal heat and sound insulation.

The air blowing opening 11 and, like it, the air blowing openings 12 and 13 are in the form of an extruded longitudinal structure seen in cross-section in FIG. 5. Referring still to the air blowing opening 11, this structure 27 is placed parallel to the window 14 and, in its upper part communicating directly with the chamber 19, it internally bounds a single longitudinal channel 28 which is sub-divided towards the bottom into three juxtaposed longitudinal channels 29, 30, 31. The channel 29 which is closest to the window 14 is bent towards this window from the channel 28. The other two channels 30 and 31 together have a passage section greater than that of the channel 29, for example twice this channel. They are bent away from the window starting from their connection to the channel 28. The channel 30 is immediately adjacent to the channel 29 and is separated from it by a longitudinal partition 32 of the structure 27. At the upper part of this partition 32, there is a longitudinal flap 34 which is hinged on this partition 32 on a longitudinal axis 33. This longitudinal flap 34 also has the form of a shaped extruded structure as shown in the figure and as can be easily conceived by those skilled in the art so that, by pivoting on the axis 33 with respect to the partition 32, it can occupy either a position shown in solid lines in FIG. 5, wherein it isolates the channel 29 from the chamber 19 by releasing a maximum passage section between the chamber 19 and the channels 30 and 31 or a position shown in dashes in FIG. 5 wherein it blocks the channels 30 and 31 with respect to the chamber 19 by releasing a maximum passage section between the chamber 19 and the channel 29 or again, any intermediate position in which the channel 29, like the channels 30 and 31, are opened towards the chamber 19 with a passage section of the latter towards the channel 29 changing conversely in relation to the section of the passage of the chamber 19 towards the channels 30 and 31, depending on the direction of the flap 34. This direction is controlled thermostatically, in a known way, for example by a temperature probe 35 placed on the flap 34 and measuring the air blowing temperature in such a way that the detection of an increase in this temperature, resulting from the observation of a drop in temperature in the room 1 by means described further below, releases a passage of air through the channel 29, namely towards the window. This passage of air is all the greater as this temperature of blown air is high. The detection of a drop in the temperature of the blown air releases, on the contrary, a passage through the channels 30 and 31 which is all the greater as this temperature of blown air is low. Naturally, other structures of air blowing openings, using other modes of distribution of blown air as a function of the temperature of this air in each room can be chosen without going beyond the scope of the present invention in any way. This method is known per se and air blowing openings thermostatically controlled in this manner are manufactured and marketed in France under the brand name "OPTIMIX" by the firm CARRIER S.A. which is a subsidiary of the CARRIER CORPORATION in Paris (France).

Advantageously, the different air conveying conduits 21, 22, 23, 24, 25, 26, have a constant section, which is identical from one conduit to another, and are flexible. Each of them can thus be extended continuously without any intermediate connector from the room in which the respectively associated air blowing opening or air suction opening is located up to the engine room 4.

Inside this room, as can be seen in FIGS. 1 and 3, the air conveying conduits 21 and 24 respectively corresponding to the air blowing opening 11 and the air suction opening 8 of the room 1 are respectively connected to an air blowing connector 35 and an air suction connector 36 of the air processing module 5 associated with this room 1. Similarly, the air conveying conduits 22 and 25 associated respectively with the air blowing opening 12 and the air suction opening 9 of the room 2 are connected inside the engine room 4 respectively to an air blowing connector 37 and an air suction connector 38 of the air-processing module 6 associated with the room 2. The air conveying conduits 23 and 26 respectively connected to the air blowing opening 13 and the air suction opening 10 of the room 3 are connected, inside the engine room 4, respectively to an air blowing connector 39 and an air suction connector 40 of the processing module 7 associated with the room 3. There is no intercommunication, namely no mixing of air among the different air conveying conduits 21, 22, 23, connected to the air blowing openings 11, 12, 13, corresponding to the different rooms. Similarly there is no communication, namely, no mixing of air, among the air conveying conduits 24, 25, 26 connected to the air suction openings 8, 9, 10, of the different rooms.

Similarly inside each of the modules 5, 6, 7, the air travels through a circuit which is independent from one module to another, i.e. this is a circuit that permits no mixing of the air that travels through the respective internal circuits of the different modules 5, 6, 7.

As FIG. 3 shows with respect to the air processing module 5, the internal circuit through which the air thus travels from the suction connector 36 to the blowing connector 35 has the general shape of a U, shown schematically in 41, the air suction connectors 36, 38, 40 of the different modules 5, 6, 7, being turned upward just like their air blowing connectors 35, 37, 39. Successively, when travelling through the circuit 41, the air arriving through the connector 36 inside the module 5 goes through a filter 42 and a heat exchanger 43 which heats or cools this air. This air is then recovered by a motor fan 45 opening onto the blowing connector 35 and providing both air suction by the opening 8 in the room 1 and the blowing of this air back by the air blowing opening 11. Similarly, the air coming to each of the modules 6 and 7 by the respective suction connectors 38, 45, successively encounters inside this module a filter, a heat exchanger and a motor fan before leaving through the respective blowing connector 37, 39, the modules 5, 6, 7, being identical in the preferred method of implementation of the invention which has been illustrated.

It will be noted that before reaching the air suction connector 36, 38, 40 of the associated air processing module 5, 6, 7, respectively, the air removed from each room 1, 2, 3, by the respective air suction opening 8, 9, 10, is mixed with fresh air coming from a fresh air supply conduit common to all the air processing modules 5, 5, 7, of the engine room 4 and advantageously suspended in a horizontal position in a ceiling zone of this engine room. The associated, respective air conveying conduit 24, 25, 26 is connected to each air suction connector 36, 38, 40 by a Tee connection piece 47, 48, 49 respectively, which is also connected to the fresh air supply conduit or piping 46 through a flowrate regulator 50, 51, 52 respectively of a known type, providing a constant predetermined flowrate of fresh air from the fresh air supply conduit or piping 46.

According to the preferred embodiment of the invention which has been shown, each of the modules 5, 6, 7, has a form such that the different modules can be suspended and juxtaposed in one and the same horizontal alignment 53 to which the fresh air supply piping or conduit, which is then rectilinear, is advantageously parallel while providing optimum possibilities of access.

Figure 2:
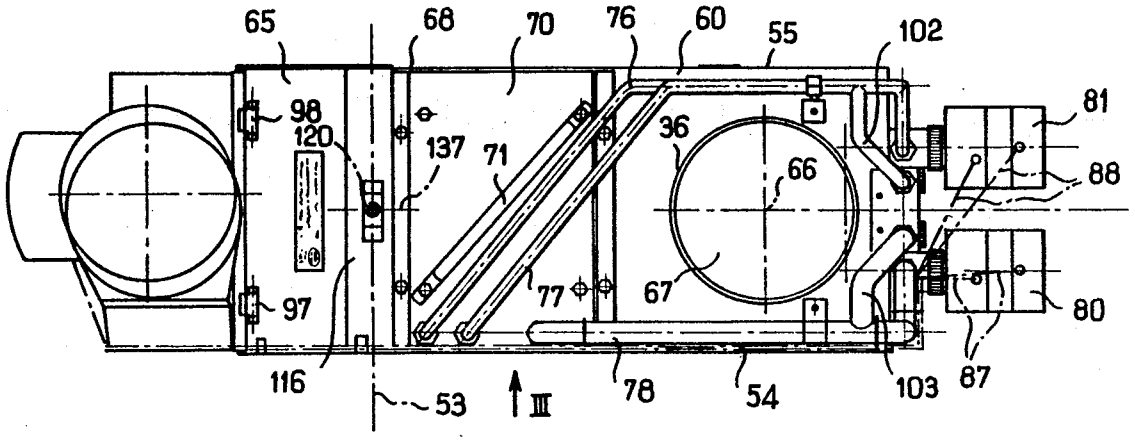
FIG. 2 shows a top view of a first embodiment of an air-processing module of this installation of a preferred type capable of being suspended and juxtaposed horizontally to other identical modules, this module occupying its suspended position.

The design, to this effect, of the module 5, 6, 7, shall now be described with reference to FIGS. 2 and which illustrate the module 5, in view of the fact that the modules 5 and 7 are identical to it, barring any differences in setting as shall be seen further below. The module shall be described in its suspended position, namely, as shown in FIGS. 2 and 3.

As shown in these figures, the module 5 has the form of a metallic chamber made by assembling metal plates or sheets which define, on the one hand, an external contour which shall be now described and, on the other hand, an internal contour which defines the internal air circuit 41 and is geometrically similar or at least approximately so, to the external contour and shall therefore not be described since it can be easily deduced from the external contour.

This external contour is characterized especially by the presence of two flat lateral faces 54, 55, which are mutually parallel and perpendicular to the alignment 53 of the modules 5, 6, 7 which are juxtaposed two by two, by these faces such as 54 and 55. To prevent direct contact of the metal plating of the modules thus juxtaposed, the face 54 is provided with attached projecting buffers 56, 57 and the face 55 is provided with attached projecting buffers 58, 59, said buffers constituting shims which maintain mutual spacing between, for example, the face 54 of the module 5 and a face of tho module 7 corresponding to the face 55 and adjacent to the face 54, and between the face 55 and a face of the module 6 corresponding to the face 54 and adjacent to the phase 55. Advantageously, the buffers 56, 57, 58, 59 are made of a vibration-absorbing material such as felt or rubber with good characteristics of slipping on sheet metal so as to enable the separation of a module from the other modules through a movement which shall be described further below. For this purpose too, the respective positions of the buffers 56, 57 on the face 54 are staggered with respect to the positions of the buffers 58 and 59 on the face 55 so as to prevent the respective buffers from being in mutual contact when the modules are juxtaposed.

It will be observed that if we leave out the buffers 56, 57, 58, 59, the module 5 is integrally located between the geometrical planes (not shown) of its lateral faces 54 and 55.

Externally, the module 5 is further demarcated by peripheral faces 60, 61, 62, 63, 64, 65 which are perpendicular to the faces 54 and 55 which they join to each other and are flat in the example shown, although other shapes can also be suitable.

The peripheral faces 60 and 62 are horizontal and respectively form an upper peripheral face and a lower peripheral face 62 of the module 5. The peripheral face 61, which connects them, is a front face with obliqueness of a few degrees of an angle with respect to the vertical, the verticality with which it is joined to the lower peripheral face 62 being withdrawn with respect to its verticality with which it is joined to the upper face 60. The peripheral faces 63, 64, 65, also together define front face of the module 5. The faces 63 and 65 are respectively connected to the lower face 62 and the upper face 60 approximately along one and the same vertical and have opposing degrees of obliqueness with respect to the vertical, of about a few degrees such that they mutually converge in the direction away from the opposite front face 61. These two faces 63 and 65 are mutually connected by the face 64. This face 64, in view of a heightwise development of the face 65, greater than that of the face 63, and in view of an obliqueness, with respect to the vertical, of the faces 63 and 65, greater than that of the front face 61, has, with respect to the vertical, an obliqueness opposite to that of the face 61 but one that is of the same magnitude.

The chamber thus defined is hermetically sealed with exceptions which shall now be described.

Near the joining of the upper face 60 with the front face 61, the sheet metal defining this upper face 60 is drilled with a cylindrical hole 67 rotating on a vertical axis 66 and around which the tubular air suction connector 36, rotating on the axis 66, is joined in an impervious way with the sheet metal defining the upper peripheral face 60.

Between the hole 67 and the connection of the upper peripheral face 60 with the peripheral face 65, the sheet metal defining this upper peripheral wall 60 is drilled with a second hole 68 forming an upper hatch for the mounting and dismounting of the heat exchanger 43 which is placed vertically inside the module 5 and is received in a detachable way, within the module, through vertical sliding pieces shown in a simple schematic way in 69 inasmuch as they can be easily designed by those skilled in the art. To provide hermetic closing of the module 5 at the hole 61 when the module is in operation, there is provided an upper lid 70 which is advantageously joined to the heat exchanger 43 and joined in a detachable way with the sheet metal forming the upper peripheral face 60 of the module 5 above this face 60, so as to make it possible to remove the heat exchanger 43, when needed, from the module 5 by simple vertical traction upwards on the lid 70 after this lid 70 has been disconnected from the plate metal defining the upper peripheral face 60 of the module 5. To this effect, the lid 70 advantageously has a grasping handle which projects upwards, that is, outside the module 5.

Advantageously, the upper lid 70 is also used as a passage for means to connect the heat exchanger 43 to energy supply means. These energy supply means are shown in this example in the form of two pairs of pipings or conduits which also supply the heat exchangers of the different modules and are advantageously suspended in a ceiling zone of the engine room 4 in a horizontal rectilinear arrangement parallel to the alignment 53. These consist of one cold water inlet piping 72 and one cold water return piping 73 connected to standard refrigerating means (not shown), one hot water inlet piping 74 and one hot water return piping 75 also connected to standard heating means (not shown) inasmuch as the heat exchanger 43 is of a type that performs both heating and cooling of air in the circuit 41 through exchange with a heat-exchanging fluid, namely water. It will be noted, however, that the air can be heated through heating electrical resistors in which case the pipings 74 and 75 will be eliminated as also the heating means, and the heating electrical resistors will be connected to an electrical supply system in a manner not shown but easily conceivable by those skilled in the art, using connection means that cross the lid 70 also on this assumption. Similarly, in a simplified alternative, it is possible to eliminate the refrigerating means and incorporate the cold water pipings 72, 73 with a system for supplying the building with drinking water so as to directly use this drinking water as cold water in the heat exchanger 43.

To enable the connection of the heat exchanger 43, with each of the conduits 72, 73, 74, 75, the upper lid 70 is vertically crossed by four tubes for conveying heat-exchanging fluid. These four tubes are a hot water inlet tube 76, a hot water return tube 77, a cold water inlet tube 78 and a cold water return tube 79. These four tubes, made of a rigid material, are bent towards the horizontal immediately above the upper lid 70 and thus extend along the upper face 60 of the module up to the position where this module is joined with the front face 61 extending along the connector 36. At the joining of the faces 60 and 61, the four tubes 76, 77, 78, 79 are bent downwards, vertically as regards the two inlet tubes 78 and 76 and along the front face 61 as regards the two return tubes 77 and 78 which are then bent towards the vertical so as to be parallel to the two other tubes 76 and 78 up to a level slightly above that of the lower face 62 of the module. The four tubes 76, 77, 78, 79, are connected rigidly but in an easily detachable way to the faces 60 and 61 of the module. In front of the front face 61, near the joining of this face with the lower face 62, i.e. preferably at shoulder height, the two tubes 78, 79, for conveying cold water are provided with a solenoid valve 80, just as the two tubes 76, 77, for conveying hot water are provided with a solenoid valve 81. At a level below that of the solenoid valves 80 and 81, the tubes 76, 77, 78 and 79 are connected by fast connectors (not shown) to a hosepipe, 82, 83, 84, 85, respectively which is itself connected to the hot water inlet piping 74, the hot water return piping 75, the cold water inlet piping 72 and the cold water return piping 73 respectively.

The valves 80 and 81 consequently make it possible to adjust the cold water and hot water flowrate respectively in the heat exchanger 43 in a manner regulated by adjustable temperature regulating means and, preferably, air flowrate regulating means of the module 5, independent of the respective corresponding means of the other modules and incorporated in a casing 86 which is preferably attached solidly, in a non-illustrated way, by one of the peripheral faces 60 to 65 of the module 5 at a position chosen in such a way that this casing 86 can be easily reached in order to adjust the regulation means while the module 5 is suspended and juxtaposed with the other modules by its lateral faces 54 and 55. The valves 80 and 81 are connected to this casing 86 by electrical conductors, 87 and 88 respectively, extending along the peripheral faces of the module 5. As an alternative, in a non-illustrated way, the casing 86 can be housed inside the module 5, in which case one of the peripheral sides 60 to 65 of this module 5 would have an access hatch to this casing 86 provided with a detachable lid as can be easily conceived by those skilled in the art, or again, it can be structurally dissociated from the module 5 and can be integrated, for example, with the corresponding cases 105, 106, respectively of the other modules 6, 7 to a central control panel or desk.

The sheet metal defining the lower peripheral face 62 of the module 5 is drilled, for its part, between the vertical to the slides 69 and the vertical to a hole 67, with a hole 89 forming a lower hatch for the mounting and removal of the filter 42 which is received inside the module 5 by vertical slides 90 which can be easily conceived by those skilled in the art and are consequently shown schematically so that the filter 42 can be removed from the module 5 or positioned by vertical sliding through the hole 89. When the module is in service, this hole 89 is closed imperviously by an attached lid 91 which then holds the filter 42 in position within the module 5. In the example shown, the lid 91 is held in a position in which the hole 89 is closed, in a detachable way, by a toggle device 92 but other methods for holding the lid 91 in a detachable way can be chosen without in any way going beyond the scope of the present invention.

The filter 42 is thus closely juxtaposed with the heat exchanger 43. An optimum distribution of the air going through the circuit 41, namely making this air come into contact with a maximum surface area of the filter 42 and with a maximum surface area of exchange inside the heat exchanger 43 is ensured by the fact that the metal plates defining the faces 60, 61 and 62, demarcate an inlet plenum chamber 93 inside the module between the air suction connector 36 and the filter 42 while the metal plates defining the peripheral faces 62, 63, 64, 60 define an outlet plenum chamber 94 with respect to the exchanger 43, in both cases with the metal plates defining the lateral faces 54 and 55 of the module.

The inlet plenum chamber 93 communicates with the air suction connector 36 through the hole 67 while the outlet plenum chamber 94 communicates with the air blowing connector 35 of the module 5 through a hole 95, forming a hatch, made in the metal plate forming the face 64 of the module 5, and through the motor fan 45 which forms a structural unit 96 with the air blowing connector 35. This structural unit 96 is attached solidly but detachably, with imperviousness around the hole 95, to the face 64 of the module 5. For this purpose, for example, the unit 96 is suspended in a detachable way by hooks 97, 98, attached so as to be solidly joined to the face 65 of the module 5 and placed against the face 64, around the hole 95 by a toggle device 99 which is itself mounted on the face 63. Naturally other modes of joining the structural unit 96 in a solid but detachable way with the other constituent elements of the module 5 can be chosen without going beyond the scope of the present invention just as the motor fan 45 can be attached in a detachable way to the other elements of the module 5 without in any way forming a structural unit with the air blowing connector 35. However, the great ease with which the motor fan 45 can be mounted and dismantled as a result of the structure illustrated and described above will be noted.

The motor fan 45 is advantageously a variable speed motor fan connected by conductors 100 to the adjustable means for regulating the module 5 in temperature and flowrate, incorporated in the casing 86. In a simplified version, the variable speed motor fan can be replaced by a fixed speed motor fan, preferably placed in the same way.

Naturally, the module 5 further has all accessory arrangements and devices known per se in the field of convection fans, and especially a condensates draining device 101 provided in the metal plate defining the lower peripheral face 62 of the module 5 and draining means 102, 103 respectively for the hot water circuit and the cold water circuit of the heat exchanger 43. These draining devices 101 and draining means 102, 103, may lead to the open air, towards the floor of the engine room as shown or, again, in a non-illustrated way, they may be connected to collecting conduits common to the different modules.

It will be observed that the air processing module 5 which has just been described is structurally independent of the other modules 6 and 7 and that consequently it can be functionally independent of these other modules.

As a matter of fact, the adjustable regulation means incorporated in the casing 86 of the module 5 are remote controlled, according to the present invention, independently of the corresponding means fitted into the other modules, from the associated room 1.

For this purpose, the adjustable regulation means built into the casing 86 associated with the module 5 are connected, as shown schematically at 103, to remote control means 104, placed inside the room 1 in which they can take the form of a fixed unit, for example, placed on a wall, or the form of a movable unit placed, for example, on a table of an occupant of this room. These remote control means 104 especially have a temperature probe that measures the effective temperature in the room 1 and means for displaying a set temperature, to control the operation of the heat exchanger 43 through the adjustable regulating means incorporated in the casing 86, namely to control the temperature of the air blown through the opening 11 by automatic action on the solenoid valves 80 and 81, and to control the speed of the motor fan 45 when it is of the variable speed type, namely to control the flowrate of air sucked in by the opening 8 and blown by the opening 11, for example, depending on the state of the solenoid valves 80 and 81 resulting from this automatic action. If necessary, the remote control means 104 may comprise display means to display other parameters making it possible to influence the operation of the associated module 5 from the room 1. For example, they may comprise a sensor to detect whether the room 1 is occupied or a switch which can be used automatically if the room is not occupied or deliberately to stop the module 5 or to make it work so as to maintain a comparatively reduced minimum temperature in the room 1. The stoppage of the module 5 implies the shutting of the valves 80 and 81 and the stopping of the motor fan 45. Similarly, the adjustable regulating means respectively associated with the two modules 6 and 7 and incorporated in the respective cases 105, 106 of these modules are respectively connected to remote control means 107 located in the room 2 and the remote control means 108 located in the room 3 as shown schematically at 109 and 110 respectively, said remote control means 107 and 108 being similar in all respects to the remote control means 104. Each module 5, 6, 7, is thus remote controlled from the associated room 1, 2, 3, respectively, independently of the other modules. The adjustable regulating means incorporated in the cases 85, 105, 106 are further connected to a common electrical supply 111 as shown respectively in 112, 113, 114.

Naturally, it is also possible to provide for centralized technical managing means shown schematically in 142 located in the engine room or outside it and electrically connected to the adjustable regulating means incorporated in the cases 86, 105, 106 as shown schematically in 143, 144, 145, respectively to control these regulating means with priority on the respectively associated remote control means 104, 107, 108, for example to lay down limits on settings or adjustments that can be made by remote control from a determined room, in particular, to fix a minimum and a maximum temperature in this room, or to lay down defined conditions, especially of temperature, in a room or a group of rooms momentarily without any possibility of remote control from this room or these rooms, respectively, or again to coercively stop one or more modules.

The modules 5, 6, 7, being preferably identical as indicated above, it is possible however, to do a basic setting of the regulation means in the casings 86, 105, 106, i.e. to do these settings in a centralized way in the engine room 4 while, at the same time, in a differentiated way depending on the respectively associated rooms 1, 2, 3.

A localizing of the casing 86 as preferred, of the valves 80, 81, the lid 91 providing access to the filter 42, the device 92 for the detachable fixing of this lid, the structural unit 96, the means 99 for its detachable fixing on the front peripheral faces and lower peripheral faces of the module 5 and in the same way on the other modules 6, 7, makes it possible to perform very frequent setting and maintenance operations on each module while these modules are juxtaposed by their plane lateral sides such as 54 and 55 as regards module 5. Action taken on the heat exchanger 43, accessible by the upper peripheral face of the module, requires the separation of this module from the other modules because, preferably, the modules are placed as close as possible to the ceiling 115 of the engine room 4 as shown in FIG. 3, but this is a minor disadvantage inasmuch as action on the heat exchanger is relatively infrequent.

Figure 4:
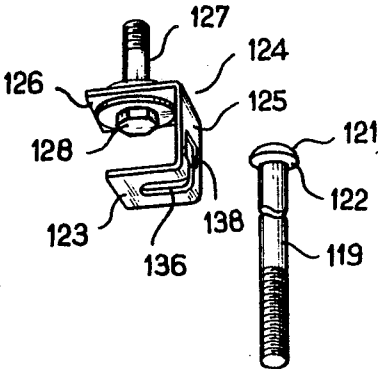
FIG. 4 shows a view in perspective of a detail of the suspension means of the module.

However, to facilitate this action, namely to facilitate the mounting and dismounting of each module independently of the other modules, a mode of suspension has been chosen in the mode of implementation of the invention shown in FIGS. 2 to 4. This mode of suspension shall now be described with reference to FIG. 5, it being understood that the other modules 6, 7, are suspended identically, independently of one another and of the module 5.

As FIGS. 2 and 3 show more particularly, the module 5 has a silentbloc 118 on its upper peripheral side 60 in a zone 116 located between the hole 68 and the junction of the side 60 with the side 65, at mid-distance between the lateral sides 54 and 55, as precisely as possible in a vertical position with respect to the center of gravity 117 of the module if this module is considered in its suspended position. This silentbloc 118 is joined towards the bottom with the metal plate defining the upper peripheral wall 60 of the module 5 and upwards with a rectilinear vertical rod 119 having an axis 120 that goes as precisely as possible through the center of gravity 117 of the module 5 in its suspended position.

Towards the top, i.e. above the silentbloc 118, the rod 119 has a solidly joined head 121 with dimensions greater than those of the rod 119, crosswise with respect to the axis 120 so as to define, towards the bottom, around the rod 119, a peripheral shoulder 122. Through this shoulder 122, the head 121 lies towards the bottom on a horizontal flat fin 123 of a U-shaped supporting strap 124, the rod 119 of which goes through this fin 123 in the immediate vicinity of the head 121. The supporting strap 124, proper to the considered module 5 as also to the rod 119, its head 121 and the silentbloc 118 has a vertical flat core 125 above the fin 123, said vertical flat core 125 being joined towards the bottom with the fin 123 and towards the top with a fin 126 which is also flat and horizontal. A bolt 127 goes through this fin 126 along the axis 120 so as to give the fin 126 a support at the bottom through a bolt head 128 and so as to be screwed above the fin 126, in a slide 129 housed inside a rectilinear rail 130 placed along the alignment 53 with which this rail is identified in the illustration of FIG. 1. The rail 30 is itself fixed to the ceiling 115 of the engine room 2. While each module such as 5 has its own slide such as 129 independent of the slides respectively associated with the other modules 6, 7, the rail 130 is common to all the juxtaposed models along one and the same alignment 53. As shown in FIG. 3, it has a rectangular section defined by two horizontal flat fins 131, 132 mutually connected by two vertical fins 333, 134, the horizontal fin 132 located under the horizontal fin being provided with a slit 135 throughout the length of the rail 130 to permit the passage of each of the bolts such as 127, keeping each of the slides such as 129 inside the rail 130, while enabling a sliding which is independent of the different slides 129 along the alignment 53. It is thus possible to juxtapose the different modules 5, 6, 7 as efficiently as possible by their respective lateral faces such as 54 and 55. To enable easy hooking and unhooking of each module such as 5 independently of the other modules, the supporting strap 124 is advantageously of a type shown in FIG. 4, the core 125 of which is oriented in a direction parallel to the alignment 53. This type of supporting strap 124 is marketed, in particular, under the registered trademark MUPRO and is characterized by the presence of a port 136 straddling the fin 123 and the core 125 with a medium plane shown schematically by 137 in FIG. 2, perpendicular to the alignment 53 and including the axis 120 of the rod 119 in the suspended position shown in FIG. 3. Perpendicular to this plane 137, the port 136 has a dimension corresponding substantially to the dimensions of the rod 119 transversally to its axis 120 especially in the immediate vicinity of its head 121, at the fin 123 as on a part of the height of the core 125 located in the immediate vicinity of the connection of this core 125 with the fin 123. At approximately mid-height on the core 125, the port 136 has a localized enlargement 138 to enable the passage of the head 121 of the rod 119 through the core 125. It will be easily seen that thus, for example, exclusively by movement of the module 5 and the rod 119 considered as a solidly joined unit, along the directions included in the plane 137, namely perpendicular to the alignment 53, the module 5 can be hooked to the supporting strap 124 or can be unhooked from it. These movements can be made while the neighboring modules 6, 7, are in position inasmuch as the module 5 can then slide by its faces 54, 55 or more precisely by the buffers 56, 57, 58, 59 of these faces against the corresponding faces respectively of the two juxtaposed modules 6, 7. Thus, in case of need, it is possible in particular to unhook a module in order to take action at its heat exchanger 43 or to replace it purely and simply without having to unhook the other modules at all. It will be observed that, owing to the flexibility of the conduits 21 and 24, the connections 82, 83, 84, 85, of the valves 80 and 81 with the pipings 72, 73, 74, 75 and the connections o the casing 86 with the associated remote control means 104 and with the electrical supply 111 if the module 5 is taken as an example, the hooking and the unhooking can be done while it remains connected, i.e. in limiting the period during which it is out of operation to the minimum. Furthermore, in order to unhook a module for example, it is not necessary to first dismount the corresponding Tee connection piece such as 47, thus making it possible to place the air suction connector such as 36 as close as possible to the ceiling 115 of the engine room 4, independently of any mounting and dismounting requirement. For this purpose, also between the fresh air supply piping or conduit 46 and each flowrate regulator 50, 51, 52 as shown, or between each flowrate regulating means 50, 51, 52 and the respectively associated Tee connector 47, 48, 49, a section of flexible piping 139, 140, 141 is advantageously interposed in a manner that is not shown.

Naturally, the mode of implementation of the invention that has just been described is only a non-exhaustive example and several alternative modes of implementation can be provided for without in any way going beyond the scope of the present invention.

In particular, these alternative embodiments may relate to the internal arrangement of the air-processing modules which, however, will remain preferably capable of being suspended in a state juxtaposed by respective plane and mutually parallel lateral faces which preferably have none of the elements on which action might have to be taken for setting or maintenance operations, for simple repairs or for the dismounting of the module. These elements will preferably remain grouped on peripheral faces which are freely accessible even when the modules are thus juxtaposed.

Figure 8:
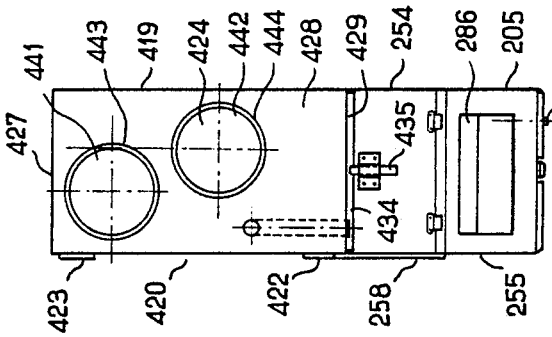
FIG. 8 shows a view of the module of FIG. 6 in the direction of the arrow VIII of this FIG. 6.
Figure 7:
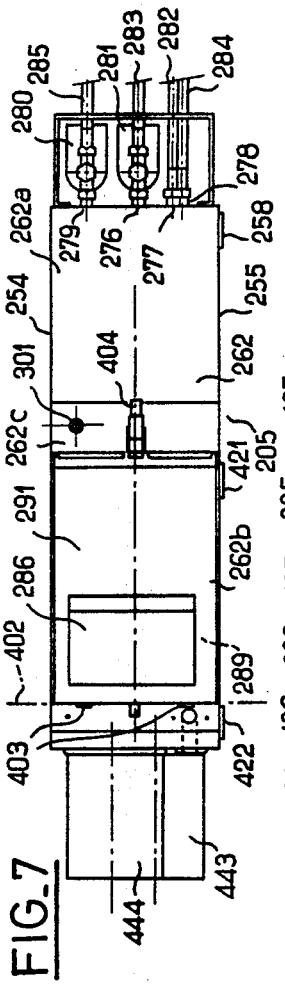
FIG. 7 shows a bottom view of the module of FIG. 6 in the direction of the arrow VII of this FIG. 6.
Figure 6:
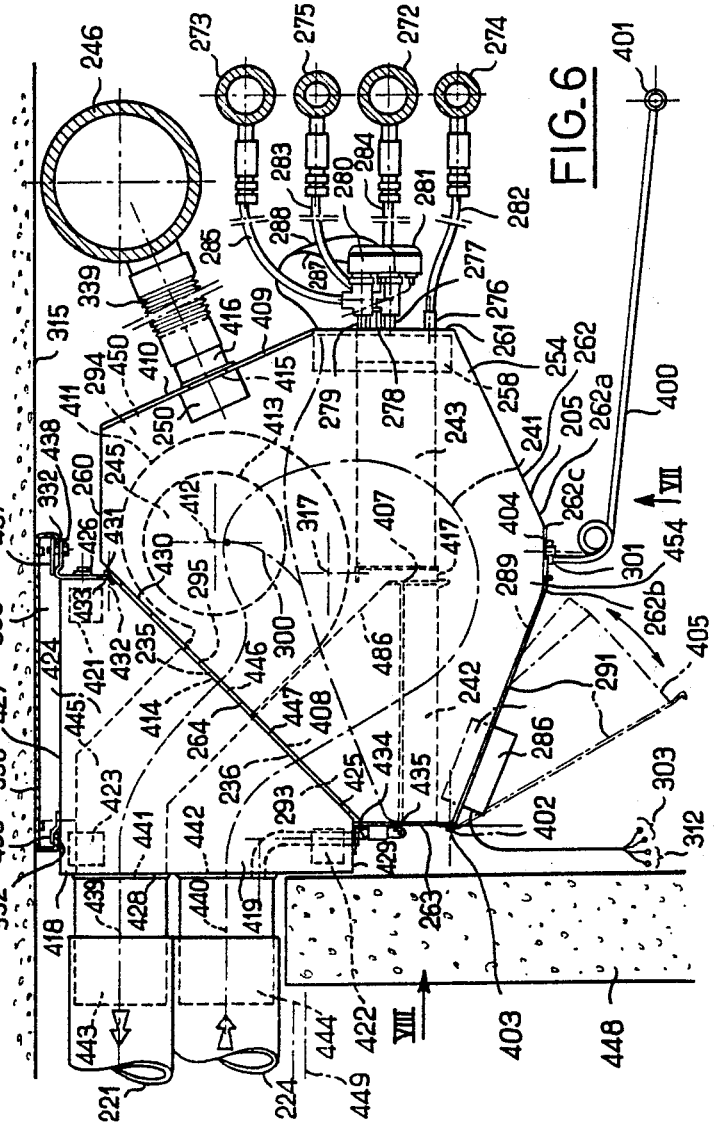
FIG. 6 shows a lateral elevation view similar to that of FIG. 3, showing a second embodiment of an air-processing module of an installation according to the present invention, also of the preferred type, capable of being suspended and juxtaposed horizontally to other identical modules, said module being illustrated as shown in the suspended state, in operation, in a battery of juxtaposed modules of this type.

An alternative of this type is shown in FIGS. 6 to 8 where 205 designates an air processing module capable of being substituted for the air-processing module 5 to serve the room 1, in a manner identical to that described with respect to the module 1. This module 205 is juxtaposed in the same way as the module 5, in the suspended state, with two other identical modules respectively serving the rooms 2 and 3.

The module 205 is similar in a great many respects to the module 5 so much so that the elements previously described under the respective references 21, 24, 35, 36, 41 to 43, 45, 46, 50, 54, 55, 58, 60 to 64, 72 to 89, 91, 93 to 95, 100, 101, 103, 112, 115, 117, 139, are seen again in FIGS. 6 to 8 or only in certain of these figures under the references 221, 224, 235, 236, 241 to 243, 245, 246, 250, 254, 255, 258, 260 to 264, 272 to 289, 291, 293 to 295, 300, 301, 303, 312, 315, 317, 339, identically or with differences which shall be described in detail further below.

Externally, these differences result in a verticality of the front peripheral faces 261 and 263, mutually joined by the lower peripheral face 262 which has the shape of a hopper defined by three plane facets perpendicular to the lateral faces 254 and 255, namely two end facets **262*a* and 262*b* which mutually converge towards the bottom respectively from the face 261 and from the face 263 and an intermediate horizontal facet 262*c* mutually connecting the two facets 262*a* and 262*b* to the lower part to define the lowest zone of the module 265, and consequently comprising the condensates draining device 301. It will be noted that this draining device, which can open out directly into the open air towards the floor of the engine room as stated with reference to the air-processing module 5, illustrated especially in FIG. 3, opens out in this example on a condensates recovering conduit 400 proper to the module 205 but conducting condensates through a collecting conduit 401 which is common to the different juxtaposed modules. An assembly of this type can naturally be adopted also in the case of modules of the type described under references 5, 6, 7**.

While the facets **262*a* and 262*c*, if an exception is made for the presence of the draining device 301, are defined by solid metal plates which also delimit the internal air circuit 241, the facet 262*b* is drilled on a major part of its length with a lower hatch 289 corresponding to the hatch 89 described above and normally closed imperviously by a flat lower lid 291 which is hinged for this purpose on a horizontal axis 402 on hooks 403 provided on the face 263 and capable also of enabling it to be unhooked since it occupies an opening position shown with dots and dashes in FIG. 6 and can be hooked in its closing position of the hatch 289, shown with solid lines, by means of a lock 404 which is borne by the facet 262*c***.

The lid 291 advantageously bears the casing 286 containing the means for regulating the air temperature and air flowrate of the module 205 outside the module 205 shown in solid lines or inside it as shown with dots and dashes. In the closed position, the lid 291 partially demarcates the internal air circuit 241 as do the metal plates respectively defining the facets **262*c* and 262*a*. For reasons of aerodynamics, the facet 262*a* and the set formed by the facet 262*b* and the lid 291 in the closed position have respective orientations of about 30° with respect to a horizontal plane and the dimensions of the facet 262*c* are as small as possible in view of the presence of the condensates draining device 101 and the lock 404**, but other arrangements can be made without going beyond the scope of the present invention.

Inside the internal air circuit 241, referring to its closed position, the lid 291 carries a cradle 405 which is solidly joined to it (and is shown with dots and dashes with the lid 291 open in FIG. 6) and this cradle 405, in a manner which can be easily determined by those skilled in the art, has a structure of a nature such that it forms a minimum obstacle to the passage of air in the internal circuit 241. This cradle bears in a detachable way, for example by being pressed on from top to bottom, the filter 242 which, unlike the filter 42 of the module 5, occupies a horizontal position inside the internal air circuit 241 when the lid 291 is closed. On the contrary, when the lid 291 is open, the filter 242 is accessible beneath the module 205 and can be detached from its cradle 405 for cleaning or changing before again closing the lid 291.

In the closed position of this lid, the horizontal filter 245, contiguous to metal plates, respectively defining the front peripheral wall 262 and the lateral walls 254 and 255, extends approximately on half the horizontal distance between the faces 261 and 263 up to an edge 407 which is perpendicular to the lateral faces 254 and 255 and through which the filter 242 is connected imperviously to an impervious partition 406 essentially defined by a flat metal plate which itself is solidly and imperviously joined to metal plates defining the lateral faces 254 and 255. From its connection with the edge 407 of the filter 242, the partition 406 rises towards the front peripheral face 263, forming an angle of about 45° to the horizontal in the non-restrictive example shown and is connected towards the top, imperviously, with a metal plate defining the front peripheral face 264 which is inclined in the reverse direction, i.e. rising towards the face 261 from its connection with the face 263, forming an angle which is also about 45° to the horizontal in this example until its connection which is direct in this case with the horizontal upper peripheral face 260 of the module 295.

The partition 406 and the metal plate which respectively define the faces 263, 264, 254, 255, together define, above the filter 242, the inlet plenum chamber 293 of the module 205. A hole 408 made in the metal plate defining the face 264, between the respective joining of this face 264 with the partition 406 and with the metal plate defining the face 263, forms the air suction connector 236 while between its connection with the partition 406 and its connection with a metal plate defining the upper face 260, the metal plate defining the face 264 has a hole 295 which itself forms the air blowing connector 235. In this mode of implementation of the invention, consequently, the air blowing connector 235 and the air suction connector 236 are juxtaposed on one and the same front peripheral face 264 of the module 205 although they remain turned upwards just as the internal air circuit 241, which the module 205 demarcates internally in an impervious way, preserves a U-shape between these two connectors 235 and 236 as can be inferred from the rest of the description.

The metal plate defining the upper peripheral face 260 of the module 205 is then not perforated and is connected to a metal plate defining the vertical front peripheral face 261 by means of a flat metal plate 409. Unlike the above-mentioned metal plates which are permanently and imperviously joined to each other, this flat metal plate 409 is joined in a detachable and impervious manner to the metal plates that respectively define the peripheral walls 260 and 261 and to the metal plates that respectively define the lateral walls 254 and 255. This metal plate 409 thus defines a front peripheral face 410 of the module 205. This face 410 is flat and perpendicular to the side faces 254 and 255 and joins the peripheral faces 260 and 261 to each other. From the face 261, the face 410 rises towards the face 263 until it joins the face 260 forming an angle of 60° with respect to the horizontal, this figure of 60° being a non-restrictive example.

Inside the module 205, the metal plate 409 defines, with the metal plates respectively defining the lateral faces 254 and 255, the peripheral faces 260 and 261, the partition 406 and that part of the metal plate that defines the peripheral wall 264 located between the partition 406 and the metal plate defining the peripheral face 260, the outlet plenum chamber 294 in which is placed the variable speed motor fan 245, in this example of implementation of the invention. This variable speed motor fan 245 is shown in this example in the form of a centrifugal fan comprising a spiral 411 which is, for example, attached in a solid but detachable way to the metal plate defining the face 255 and which has, along a horizontal axis 412 inside the outlet plenum chamber 294, a suction feature 413. This spiral 11 has a discharge feature 414 directly facing the hole 295 in impervious connection with this hole 295.

Furthermore, in this embodiment, inside the outlet plenum chamber 294, there opens a fresh air suction connector 416 through a hole 415 made centrally in the metal plate 409. This fresh air suction connector 416 is joined to this metal plate or sheet 409 and is connected by a fast fit-on hosepipe 339 to the fresh air supply piping or conduit 246. Inside the outlet plenum chamber 294 and immediately facing the connector 416 there is placed the fresh air flowrate regulator 251 joined to the metal plate 409. As will be seen further below, the metal plate 409 thus provided with the fresh air suction connector 416 and the fresh air flow regulator 250 can be replaced by a solid metal plate in an alternative embodiment of the module 205 which shall be described as an ancillary part of the description of FIG. 9.

Naturally, following the internal air circuit 241, the air that has crossed the filter 242 goes through the heat exchanger 243 which heats or cools this air before reaching the outlet plenum chamber 294 provided with the variable speed motor fan 245 and, in the example shown, with the fresh air regulator 250. In the module 205, and unlike what has been described with reference to the module 5, this heat exchanger 243 is directed horizontally and juxtaposed horizontally to the filter 242, between the edge 407 of this filter and the metal plate defining the front peripheral wall 261 through which the tubes 276, 277, 278 and 279 leave with impervious sealing, said tubes respectively corresponding to the tubes 76, 77, 78, 79, described above. The heat exchanger 243 is connected to the filter 242 by a horizontal imperviously sealed partition 247 which is also joined imperviously to the metal plates respectively defining the side walls 254 and 255. The heat exchanger 243 is also contiguous and imperviously joined to the metal plates defining the walls 254 and 255 and, it is joined solidly to them in this embodiment although a detachable assembly, for example on slides similar to the one described with reference to FIG. 5, barring the orientation, is also possible. Similarly, a solidly joined assembly can also be chosen for a vertical orientation of the heat exchanger similar to the one described with reference to the module 5. Between the filter 242 and the heat exchanger 243, on the one hand, and the metal plates defining the face 262 as well as the lid 291 on the other hand, the internal air circuit goes through an intermediate plenum chamber 454 in which the air is deflected by 180°.

It will be noted that because the tubes 276, 277, 278, 279 leave the air-processing module 205 through the front peripheral face 261 of this module, they can be as short as possible, and can have the solenoid valve 280 and 281 (provided in this example respectively on the tube 279 and on the tube 276) directly in front of this face. However, these solenoid valves 280 and 281 remain directly accessible to an operator in case of need and are connected by hosepipes, 285 and 283 respectively to the pipings 273 and 275 respectively corresponding to the pipings 73 and 75 described above, while the tubes 276 and 278 are connected by hosepipes 282 and 284 respectively to the pipings 274 and 272 respectively corresponding to the pipings 74 and 72 described above. The connection of each of the hosepipes with the corresponding piping respectively is done advantageously by a fast respective connector making it easier to dismount the module 205 in case of need.

Naturally, the heat exchanger 243 may have the same alternative embodiments as the heat exchanger 43 with the same consequences as regards its energy supply mode.

It will be noted that, as compared with the module described with reference to FIGS. 2 and 3, the module 205 which has just been described can have smaller bulk along its height thus making it possible to house a row of modules of this type, aligned horizontally, between the upper level of an entrance door to the engine room and the ceiling slab 315 of this room, i.e. making it possible to limit the floor area needed for the engine room.

Figure 9:
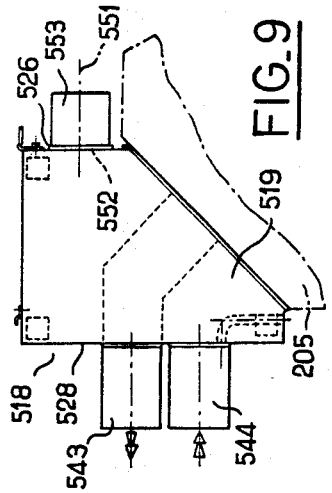
FIG. 9 shows, in a view similar to that of FIG. 6, but in a partial one, an alternative method of suspension and connection to the fresh air supply means of the module according to the second embodiment.

This heightwise compactness of the module 205 is also helped by the preferred suspension mode of this module 205 to the ceiling 315 of the engine room which is shown in FIGS. 6 and 8 and, in an alternative mode, in FIG. 9.

Referring to FIGS. 6 and 8 and especially to FIG. 6, it is seen that the module 205 is of course suspended to the ceiling 315 by means of a rail 330 which is fixed to the ceiling 315 and is common to all the juxtaposed modules as with the rail 130 described above, but that this suspension is done by means of a chamber 418 also used as an intermediary for connecting the air suction conduit 224 and air discharge conduit 221, respectively corresponding to the conduits 24 and 21 described earlier with the connector 236 shown by the hole 408 and the connector 235 shown by the hole 295 respectively.

Since it is planned that the air-processing module 205 will be juxtaposed by flat lateral sides 254 and 255 to other identical modules, the chamber 418 is demarcated especially by two flat lateral faces 419 and 420 which are coplanar with the faces 254 and 255 respectively and are juxtaposed by these faces 419 and 420 with the similar chambers used to suspend two air processing modules (not shown) adjacent to the module 205 and to connect these two modules with the respective air suction opening and air-blowing opening. It will be seen that, like the air-processing modules such as 205 to which they correspond, the different suspension and connection chambers are structurally and functionally independent of each other.

Preferably, buffers such as 421, 422, 423, are joined solidly to one of the side faces of the chamber 418 (the face 420 in the example shown) .or on both of its side faces (in a manner not shown) these buffers being attached so as to form projections and constituting shims between the different juxtaposed chambers, capable of absorbing vibrations and, if necessary, making it easier for a chamber to slide on adjacent chambers in the event of dismounting.

Between the side faces 419 and 420, the chamber is delimited by a set of flat peripheral faces perpendicular to these faces 419 and 420 and defined, like these latter faces, by respective metal plates which are mutually joined to each other and are contiguous in an impervious manner to demarcate an internal volume 424 imperviously within the chamber 418. These peripheral faces are respectively designated by the references 425, 426, 427, 428 and 429.

The peripheral face 425 has an obliqueness identical to that of the face 264 of the module 205, while, at the same time, being turned downwards while the face 264 is turned upwards so as to be applied flat against this face 264 by means of a seal 430 especially around the holes 408 and 264 respectively defining the suction connector 236 and the blowing connector 235 between which the seal 430 maintains an impervious separation. The face 425 is joined, respectively towards the top and towards the bottom, to the vertical face 426 which is oriented identically to the face 261 of the module 205, and to a horizontal lower face 429. The face 426 has hooks 431 on which the module 205 is suspended so as to be hinged on a horizontal axis 432 perpendicular to these faces 254 and 255, by rings 433 joined to its face 264, substantially vertical to its center of gravity 317. The latter face 429 has, in the vicinity of its junction with the face 425, a vertical shoulder 434 that works detachably with a lock 435 carried by the face 263 of the module 205. The module 205 and the chamber 418 are thus locked mutually in a position in which the faces 264 and 425 are mutually supported and may apply heavy pressure to the seal 430. However, after mutual unlocking by action on the lock 435, the module 205 can be made to pivot on the axis 432 with respect to the chamber 418 and then, after sufficient tilting, the module can be unhooked from the hooks 431 if damage to this said air-processing module 205 requires it to be dismantled or preferably replaced by another similar module. This module will of course be hooked to the hooks 431 and then brought by tilting to a position where the seal 430 is crushed between the faces 429 and 264, with a locking of the lock 435 on the shoulder 434.

Towards the top, the face 426 is connected to the face 427 or horizontal upper face turned upwards, which is itself joined to the lower face 429 by the face 428 which is vertical and turned in the opposite direction to the face 426.

Near its junction with the face 428 and its junction with the face 426, respectively, the upper face 427 of the chamber 418 has horizontal lugs 436 and 437, solidly joined and detachable respectively. These horizontal lugs 436 and 437 provide for hooking to a horizontal fin 332 of the rail 330 into which these two lugs enter by a slit 335. The horizontal fin 332 and the slit 335 respectively correspond to the horizontal fin 132 and the slit 135 of the rail 30, to which the rail 330 is quite similar when seen in cross-section as is the case in FIG. 6, except for the fact that, when it is seen thus in a section, it is firstly lower and secondly wider than the rail 130 just as the slit 335 is much wider than the slit 135 so much so that the horizontal fin 332 is limited to two horizontal shoulders which are comparatively narrower than the slit 135 which separates them. The detachable lug 437 is, for example, bolted to a horizontal lug 438 which is solidly joined to the face 426 and overhangs it, and is supported under the fin 332 of the rail 330 enabling a separation at will, of the lugs 437 and 438 to release the chamber 418 from the rail 330. It will be noted that the upper face 260 of the module 205 is, for this purpose, slightly shifted downwards with respect to the lug 438 and its bolt (not identified) for connection with the lug 437.

The metal plate defining the face 428 of the chamber 418 is drilled, along respective horizontal axes 439 and 440, with two circular holes 441, 442 each of which is extended along its axis, overhanging the face 428 by a respective tubular connection 443, 444, to which the air-blowing conduit 221 and the air suction conduit 224 can be fitted on in a detachable way respectively. Inside the volume 424, the hole 441 placed at a level higher than that of the hole 442 and shifted towards the face 420 of the chamber 418 with respect to this hole 442, opens out onto a bent tubular conduit 445 which thus provides impervious connection, while maintaining imperviousness with respect to the rest of the internal volume 424 of the chamber 418, between the hole 441 and a hole 446 made in the metal plate defining the lateral face 425 and opening out directly in front of the hole 264 defining the air-blowing connector 235 of the module 205. The hole 442 is, for its part, in direct communication with the rest of the internal volume 424 of the chamber 418 which communicates with the hole 408 defining the air suction connector 236 by a hole 447 made, immediately facing this hole 447, in the metal plate defining the face 425 of the chamber 418. It can be seen that a mode of suspension of this type for the module 205 permits great heightwise compactness beneath the ceiling 315 and considerably facilitates dismounting and remounting operations of a module such as the module 205 since the prior dismounting of the air suction conduit 224 or the air blowing conduit 221 is not needed for this effect.

The arrangements that have just been described also enable a reduction in the overall space factor of the module 205 in the engine room since it is possible to attach the chamber 418 by its face 422 to a wall 448 of this engine room, said wall 448 being suitably drilled in the vicinity of the ceiling 315 to let through the connectors 443 and 444 and the conduits 221 and 224, advantageously housed on the other side of the wall 448 between the ceiling 315 and a false ceiling 349. An assembly of this type is possible while preserving optimum conditions of access to the inside of the air-processing module 205, and especially to the filter 242 which can be reached through the lower hatch 289 after opening the lid 291, and to the motor fan 245 which is advantageously mounted in a detachable way within the outlet plenum chamber 294 and is accessible in case of need, by dismounting the metal plate 409 to release, between the metal plates respectively defining the faces 260, 261, 254, 255 of the module 205, a front hatch 450 for which the metal plate 409 acts as a lid.

It will be observed, that as an alternative embodiment of the module 205 which, moreover, remains unchanged, the above-described metal plate 409, provided with a hole 415, a connector 416 and a flowrate regulator 250 for the introduction of fresh air from the fresh air piping or conduit 246 into the outlet plenum chamber 294 can be replaced by a solid plate which then acts solely as a detachable lid for the impervious closing of the front hatch 450 for access to the motor fan 245, in providing for the connection of the module 205 to the fresh air supply piping or conduit 246 at a chamber 518 replacing the chamber 418.

A chamber 518 of this type has been shown in FIG. 9 where the same references as those of FIG. 6, incremented by 100, are repeated to designate the various parts of this chamber: the chamber 518 is identical to the chamber 418 in all respects except that its vertical faces, namely its lateral faces such as 519 and its peripheral faces 526 and 528 are higher than the lateral faces 419 and 420 and the peripheral faces 426 and 428 respectively of the chamber 418 and that in the metal plate defining lateral face 526, there is a circular hole 552 made along a horizontal axis 551 and extending outwards of the chamber 518 by a coaxial tubular connector 553 to which is fitted in a detachable way (not shown) a connecting conduit with the fresh air supply piping or conduit 246. Moreover, the chamber 518 remains unchanged, especially as regards its mode of cooperation with the air-processing module 205 and the rail 330.

An alternative embodiment 518 of this type of the chamber for the connection and suspension of the air-processing module 205, by connecting the connectors 543 and 543 respectively to an air blowing conduit 221 and an air suction conduit 224, as stated with respect to the chamber 418, and by further connecting the connector 553 to the fresh air supply piping or conduit 246 through a flow regulator (not shown) corresponding to the flowrate regulator 50 of the mode of implementation of the invention, illustrated especially in FIG. 3, makes it possible to make the air-processing module 205 work identically to the one described in the relation to the air-processing module 5, namely, by introducing a mixture of stale air from the room associated with the module 205, coming through the conduit 224, and fresh air introduced in a determined flowrate from the air piping or conduit 246 into the internal air circuit 241 through the air suction connector 236. In this case there would also be provision for a flowrate regulator (not shown) to regulate the flowrate between the connector 544 and the stale air suction conduit 224, said flowrate regulator and the regulator of the flowrate provided between the connector 553 and the fresh air supply piping or conduit 246 being controlled by the adjustable regulation means of the module 205 contained in the casing 286 and being coupled so that the respective flowrates of air entering the chamber 518 through the connectors 544 and 553 are mutually complementary depending on the adjusted flowrate of the motor fan 245. It will be noted that the flowrate regulator 250 of the air processing module 205 shown in FIG. 6 can also be controlled by the adjustable regulating means of this module. In this case, there will preferably be provision for a controlled flowrate regulator at the connector 544 or the connector 236. It is also possible to make the chamber 518 work identically to the chamber 418 by imperviously closing the connector 553 and diverting the connectors 543 and 544 to the conduits 221 and 224 in the manner described with respect to the connectors 443 and 444 respectively providing for a fresh air supply at the outlet plenum chamber 294 in the manner shown in FIG. 6. This chamber 518, however, offers yet another possibility which consists in blocking off the connector 544, in the absence of the conduit 224, in assuming that the room with which the module 205 is associated is also provided with stale air suction means of any type known per se, in connecting the connector 553 to the fresh air supply piping 246 and the connector 543 to the air-blowing conduit 221, to supply the latter exclusively with fresh air carried to a desired temperature when passing through the exchanger 243 and blown at a flowrate depending on the speed of the variable speed motor fan 245. It will be noted that an approach of this type is also accessible for a module of the type shown in 5 of FIG. 3, by eliminating the air suction conduit 24, enclosing the corresponding side of the connecting Tee 47 and eliminating the flowrate regulator 50 in the connection between this Tee 47 and the fresh air supply piping 46.

Naturally, the alternative means of implementing the invention which have just been described with reference to FIGS. 7 and 9 are only non-restrictive examples and other alternatives can yet be envisaged without in any way going beyond the scope of the present invention.

What is claimed is:

1. An air-processing installation designed for the ventilation and air-conditioning of several rooms, and comprising, to this effect, air-processing means housed in an engine room, at least one air blowing opening and at least one air suction opening in each room and conduits to connect said air blowing and air suction openings to the air-processing means.

wherein said air processing means comprises several air processing modules grouped together in said engine room and wherein said air suction and air blower conduits connect each module with a respective room independently of the other rooms and other air-processing modules:

an air suction connector connected by a respective conduit to the air suction opening of the respectively associated room, an air blowing connector connected to the air blowing opening of the respectively associated room by a respective conduit, an internal air circuit within each module connecting said air suction and air blowing connectors to each other, ventilation and air-conditioning means interposed in each said internal air circuit within each module, means for connecting the ventilation and air-conditioning means within each module to energy supply means, adjustable means to regulate the ventilation and air-conditioning means within each module at least as regards air temperature within a respective room, and wherein there are provided respective means for the remote control of adjustable means for the regulation of the ventilation and air-conditioning means of each air-processing module from the respectively associated room.

2. An installation according to claim 1 further comprising means to supply the air-processing modules with fresh air.

3. An installation according to claim 1 wherein the air-processing modules are identical.

4. An installation according to claim 1 wherein each air-processing module is bounded externally by two mutually parallel flat lateral faces and by peripheral faces which connect said lateral faces to each other and group the supporting means of said module, said air suction and air blowing connectors, said connection means to energy supply means an axis means to said ventilation and air-conditioning means, and wherein the modules are juxtaposed with each other by said flat lateral spaces.

5. An installation according to claim 2 wherein the adjustable regulation means associated with each air-processing module are borne by it and wherein the peripheral faces of each air-processing module comprise access means to said respective adjustable regulation means.

6. An installation according to claim 4 wherein the supporting means of the different modules are independent of each other and capable of enabling each module to be separated from the other ones by a shift along directions parallel to said flat lateral faces.

7. An installation according to claim 4 wherein said flat, lateral faces are vertical and wherein the modules are mutually juxtaposed horizontally.

8. An installation according to claim 7 wherein the supporting means of each module comprise means for the suspension of said module and wherein each module is suspended in a zone of the engine room ceiling.

9. An installation according to claim 8 wherein said suspension means for each module are located in an upper peripheral zone of the said module, vertical to the center of gravity of this module.

10. An installation according to claim 8 wherein, in the engine room, the conduits are arranged in said ceiling zone and wherein the air suction and blowing connectors of each module are turned upwards and wherein the internal air circuit of each module has a U shape between said air suction connector and air blowing connector of this module.

11. An installation according to claim 10 wherein the suspension means of each module comprise a respective intermediate chamber for connection of said air suction and air blowing connectors of this module to the respectively corresponding conduits, and means for the detachable joining of each intermediate chamber with the respectively associated module on a peripheral face of this module.

12. An installation according to claim 11 wherein each chamber externally has two flat lateral sides which extend the lateral sides of the respective associated module in a coplanar way and peripheral faces assembling means for connection with the respective air suction and air blowing conduits, means for connection with the air suction and air blowing connectors of the respectively associated module, means for detachable joining with said module and means for the suspension of the intermediate chamber.

13. An installation according to claim 10 wherein the ventilation and air-conditioning means for each module comprise a respective vertical filter and at least one respective vertical heat exchanger, juxtaposed with each other horizontally, and wherein said internal circuit has an inlet plenum chamber between said filter and the respective air suction connector and an outlet plenum between said head exchanger and the respective air-blowing connector.

14. An installation according to claim 13 wherein each module has vertical slide means for the detachable receiving of the respectively associated filter, a lower hatch for the mounting and dismounting of the filter by sliding, in said vertical slides, on a lower peripheral surface of said module, and a lower, detachable lid to close said lower hatch.

15. An installation according to claim 13 wherein each module has vertical slides for the detachable receiving of the respectively associated heat exchanger, an upper hatch for the mounting and dismounting of the exchanger by sliding, in said vertical slides, on an upper peripheral surface of said module, between said air suction and air blowing connectors and an upper detachable lid to close said upper hatch, and wherein the means for connecting the ventilation and air-conditioning means to the energy supply means are connected to the heat exchanger at the said upper removable lid.

16. An installation according to claim 10 wherein the ventilation and air-conditioning means of each module comprise a respective horizontal filter and at least one respective horizontal heat exchanger, mutually juxtaposed horizontally, and wherein said internal air conduit has an inlet plenum chamber between said filter, above it, and the respective air suction connector, an intermediate plenum chamber beneath said filter and said heat exchanger, and an outlet plenum chamber between said heat exchanger, above it, and the respective air blowing connector.

17. An installation according to claim 16 wherein each module comprises a movable cradle to receive the respectively associated filter, a lower hatch for the mounting and dismounting of the filter on a lower peripheral face of said module, and a detachable lower lid to close said lower hatch bearing said cradle.

18. An installation according to any one of claims 13 or 16 wherein said heat exchanger of each module is of a heat-exchanging fluid circulation type, wherein the energy supply means have an inlet piping for heat-exchanging fluid and a return piping for heat-exchanging fluid common to all the air-processing modules and wherein the connection means to connect the ventilation and air-conditioning means of each module to energy supply means comprise two respective tubes to convey said heat-exchanging fluid, respectively connected to said inlet piping and to said return piping and placed so as to face a peripheral face of said module and a respective adjusting valve placed in on of said tubes, facing a front peripheral face of said module and connected to said respective adjustable regulation means.

19. An installation according to claim 10 wherein the ventilation and air-conditioning means of each module have a respective motor fan adjoining the respective air blowing connector, and wherein each module has means for mounting and dismounting the motor fan accessible through a front peripheral face of said module.

20. An installation according to claim 19 wherein the motor fan of each module constitutes a structural unit with the respective air blowing connector and wherein each module comprises a front hatch on a front peripheral face adjoining the respective air blowing connector and detachable fastening means for said structural unit around and before said front hatch.

21. An installation according to claim 19 wherein the motor fan of each module is housed detachably inside the respective internal air circuit, and wherein each module has, facing said motor fan, a front hatch on a front peripheral face and a detachable front lid to close said front hatch.

22. An installation according to claim 1 wherein the ventilation and air-conditioning means of each module comprise a respective motor fan of a variable speed type connected to said, respective adjustable regulation means.

23. An installation according to claim 2 wherein the fresh air supply means comprise a fresh air piping common to all the air-processing modules and wherein, for each module, there are respective means to connect the respective air suction connector with said fresh air piping, comprising respective fresh air flowrate regulating means.

24. An installation according to claim 2 wherein each air-processing module is bounded externally by two mutually parallel, flat, lateral faces and by peripheral faces which connect said lateral faces to each other and group the supporting means of said module, said air suction and air blowing connectors, said connection means to energy supply means an access means to said ventilation and air-conditioning means, and wherein the modules are juxtaposed with each other by said flat lateral faces in combination wherein the fresh air supply means comprise a fresh air piping common to all the air-processing modules and wherein, for each module, there are respective means to connect said respective internal circuit with said fresh air piping, said respective connecting means being located on a peripheral face of the respective module and comprising respective fresh air flowrate regulating means.

25. An installation according to claim 1 wherein each air blowing opening comprises a thermostatic flap to orient the blown air according to the blowing temperature.

26. An installation according to claim 1 wherein the conduits have identical and constant sections.

27. An installation according to claim 1 wherein the conduits are flexible at least locally, inside the engine room.

28. An installation according to claim 1 wherein the means to connect the ventilation and air-conditioning means to energy supply means are flexible, at least locally in the engine room.

29. A plurality of air-processing modules, each module comprising:

an air suction connector capable of receiving an air suction conduit;

an air blowing connector cable of receiving an air blowing conduit;

an internal air circuit connecting said air suction and air blowing connectors to each other, ventilation and air-conditioning means interposed in said internal air circuit;

adjustable and remote-controlled means for the regulation of the ventilation and air-conditioning means, at least in air temperature, said modules being bounded externally by two flat, mutually parallel lateral faces and by peripheral faces which join said lateral faces together, and supporting means for said modules, said supporting means grouping said air suction and air blowing connectors, and accessible means for connecting said ventilation and air conditioning means and to energy supply means, wherein several modules are juxtaposed with respect to each other by said flat lateral faces thereof.

30. A module according to claim 29 bearing said adjustable regulation means, said peripheral faces comprising means of access to said adjustable regulation means.

31. A module according to claim 29 wherein the supporting means are capable of enabling a deliberate shifting of said module in directions parallel to said flat lateral sides.

32. A module according to claim 29 wherein the supporting means comprise means for the suspension of said module in a suspension position wherein said flat lateral faces are vertical.

33. A module according to claim 32 wherein the suspension means are located in an upper peripheral zone of the said module, vertical to the center of gravity of the module in said position of suspension.

34. A module according to claim 32 wherein said air suction and air blowing connectors are turned upwardly in said suspension position, and wherein said internal air circuit of the module has the shape of a U between said air suction and air blowing connectors.

35. A module according to claim 32 wherein the suspension means comprise an intermediate chamber for connection between said air suction and air blowing connectors, on the one hand, and the respective, corresponding conduits on the other, and means to join said intermediate chamber detachably to the module on a peripheral face of the module.

36. A module according to claim 35 wherein the intermediate chamber has two external lateral faces forming a coplanar extension of said lateral faces of the module, and peripheral faces assembling means for connection with air suction and blowing conduits, means for detachable joining with the module and means for the suspension of the intermediate chamber.

37. A module according to claim 34 wherein the ventilation and air-conditioning means comprise a filter and at least one heat exchanger which are mutually juxtaposed horizontally and are vertical in said position of suspension, and wherein said internal circuit comprises an inlet plenum chamber between said filter and the air suction connector, and an outlet plenum chamber between said heat exchanger and the air blowing connector.

38. A module according to claim 37 comprising vertical slides for the movable receiving of the filter, a lower hatch for the mounting and dismounting of the filter by sliding it in said vertical slides on a lower peripheral face of the module, and a detachable lower lid to close said lower hatch, referring to its suspended position.

39. A module according to claim 37 comprising vertical slides for the movable receiving of the heat exchanger, an upper hatch for the mounting and dismounting of the exchanger by sliding it in said vertical slides on an upper peripheral face of the module, between said air suction and air blowing connectors, and a detachable upper lid to close said upper hatch, and wherein the means for connecting the ventilation and air-conditioning means to the energy supply means are connected to the heat exchanger at the upper detachable lid, referring to said suspended position.

40. A module according to claim 34 wherein the ventilation and air-conditioning means comprise a filter and at least one heat exchanger which are horizontal and are mutually juxtaposed horizontally in said position of suspension, and wherein said internal air circuit comprises an inlet plenum chamber between said filter, above it, and the air suction connector, an intermediate plenum chamber beneath said filter and said heat exchanger, and an output plenum between said heat exchanger, above it, and the air blowing connector, referring to said position of suspension.

41. A module according to claim 40 comprising a movable cradle to receive the filter, a lower hatch for the dismounting of said filter on a lower peripheral face of said module, and a detachable lower lid to close said lower hatch bearing said cradle, referring to the position of suspension.

42. A module according to claim 37 wherein said heat exchanger of each module is of a heat-exchanging fluid circulation type and wherein the means for connecting the ventilation and air-conditioning system to the energy supply means comprise two tubes, for the inlet and return, respectively, of said heat-exchanging fluid, placed so as to face a peripheral face of said module and a respective adjusting valve placed in one of said tubes, facing a front peripheral face of said module, referring to the position of suspension, and connected to said respective adjustable regulation means.

43. A module according to claim 34 wherein the ventilation and air-conditioning means comprise a motor fan adjoining the air blowing connector, and comprise means for mounting and dismounting the motor fan accessible through a front peripheral face of the module, referring to the position of suspension.

44. A module according to claim 43 wherein the motor fan constitutes a structural unit with the air blowing connector and wherein the module comprises a front hatch on said front peripheral face adjoining the air blowing connector and means for the detachable fixing of said structural unit around and before said front hatch.

45. A module according to claim 43 wherein the motor fan is housed detachably inside said internal air circuit, and wherein the module has, facing said motor fan, a front hatch on said front peripheral face and a detachable front lid to close said front hatch.

46. A module according to claim 29 wherein the ventilation and air-conditioning means comprise a variable speed motor fan connected to said adjustable regulation means.

47. A module according to claim 29 comprising a connector that links said internal air circuit with a fresh air piping arranged on a peripheral face.

48. A module according to claim 47 wherein said linking connector comprises flowrate regulating means.

49. A module according to claim 40 wherein said heat exchanger of each module is of a heat-exchanging fluid circulation type and wherein the means for connecting the ventilation and air-conditioning system to the energy supply means comprise two tubes, for the inlet and return, respectively, of said heat-exchanging fluid, placed so as to face a peripheral face of said module and a respective adjusting valve placed in one of said tubes, facing a front peripheral face of said module, referring to the position of suspension, and connected to said respective adjustable regulation means.

50. An air-processing installation designed for the ventilation and air-conditioning of several rooms, and comprising to this effect, air-processing means housed in an engine room, at least one air blowing opening and at least one air suction opening in each room and conduits to connect said air blowing and air suction openings to the air-processing means, wherein said air processing means comprise several air-processing modules grouped together in said engine room and wherein each module is associated with a respective room and comprises, independently of the other air-processing modules:

an air suction connector connected by a respective conduit to the air suction opening of the respectively associated room, air blowing connector connected to the air blowing openings of the respectively associated room by a respective conduit, an internal air circuit connecting said air suction and air blowing connectors to each other, ventilation and air-conditioning means interposed in said internal air circuit, means for connecting the ventilation and air-conditioning means to energy supply means, adjustable means to regulate the ventilation and air-conditioning means at least as regards air temperature, and wherein there are provided respective means for the remote control of the adjustable means for the regulation of the ventilation and air-conditioning means of each air-processing module from the respectively associated room, each air-processing module bounded externally by two mutually parallel, flat, lateral faces and by peripheral faces which connect said lateral faces to each other and group; the supporting means of said module, said air suction and air blowing connectors, said connection means to energy supply means and access means to said ventilation and air-conditioning means, and wherein the modules are juxtaposed with each other by said flat lateral faces.

51. An installation according to claim 50 wherein the adjustable regulation means associated with each air-processing module are borne by it and wherein the peripheral faces of each air-processing module comprise access means to said respective adjustable regulation means.

52. An installation according to claim 50 wherein the supporting means of the different modules are independent of each other and capable of enabling each module to be separated from the other ones by a shift along directions parallel to said flat lateral faces.

53. An installation according to claim 50 wherein said flat, lateral faces are vertical and wherein the modules are mutually juxtaposed horizontally.

54. An installation according to claim 53 wherein the supporting means of each module comprise means for the suspension of said module and wherein each module is suspended in a zone of the engine room ceiling.

55. An installation according to claim 54 wherein said suspension means for each module are located in an upper peripheral zone of the said module, vertical to the center of gravity of this module.

56. An installation according to claim 54, wherein, in the engine room, the conduits are arranged in said ceiling zone and wherein the air suction and blowing connectors of each module are turned upwards and wherein the internal air circuit of each model has a U shape between said air suction connector and air blowing connector of this module.

57. An installation according to claim 56 wherein the suspension means of each module comprise a respective intermediate chamber for connection of said air suction and air blowing connectors of this module to the respectively corresponding conduits, and means for the detachable joining of each intermediate chamber with the respectively associated module on a peripheral face of this module.

58. An installation according to claim 57 wherein each chamber externally has two flat lateral sides which extend the lateral sides of the respective associated module in a coplanar way and peripheral faces assembling means for connection with the respective air suction and air blowing conduits, means for connection with the air suction and air blowing connectors of the respectively associated module, means for detachable joining with said module and means for the suspension of the intermediate chamber.

59. An installation according to claim 56 wherein the ventilation and air-conditioning means for each module comprise a respective vertical filter and at least one respective vertical heat exchanger, juxtaposed with each other horizontally, and wherein said internal circuit has an inlet plenum chamber between said filter and the respective air suction connector and an outlet plenum between said head exchanger and the respective air-blowing connector.

60. An installation according to claim 54 wherein each module has vertical slide means for the detachable receiving of the respectively associated filter, a lower hatch for the mounting and dismounting of the filter by sliding, in said vertical slides, on a lower peripheral surface of said module, and a lower, detachable lid to close said lower hatch.

61. An installation according to claim 54 wherein each module has vertical slides for the detachable receiving of the respectively associated heat exchanger, an upper hatch for the mounting and dismounting of the exchanger by sliding, in said vertical slides, on an upper peripheral surface of said module, between said air suction and air blowing connectors and an upper detachable lid to close said upper hatch, and wherein the means for connecting the ventilation and air-conditioning means to the energy supply means are connected to the heat exchanger at the said upper removable lid.

62. An installation according to claim 56 wherein the ventilation and air-conditioning means of each module comprise a respective horizontal filter and at least one respective horizontal heat exchanger, mutually juxtaposed horizontally, and wherein said internal air circuit has an inlet plenum chamber between said filter, above it, and the respective air suction connector, an intermediate plenum chamber beneath said filter and said heat exchanger, and an outlet plenum chamber between said heat exchanger, above it, and the respective air blowing connector.

63. An installation according to claim 62 wherein each module comprises a movable cradle to receive the respectively associated filter, a lower hatch for the mounting and dismounting of the filter on a lower peripheral face of said module, and a detachable lower lid to close said lower hatch bearing said cradle.

64. An installation according to claim 54 wherein said heat exchanger of each module is of a heat-exchanging fluid circulation type, wherein the energy supply means have an inlet piping for heat-exchanging fluid and a return piping for heat-exchanging fluid common to all the air-processing modules and wherein the connection means to connect the ventilation and air-conditioning means of each module to energy supply means comprise two respective tubes to convey said heat-exchanging fluid, respectively connected to said inlet piping and to said return piping and placed so as to face a peripheral face of said module and a respective adjusting valve placed in one of said tubes, facing a front peripheral face of said module and connected to said respective adjustable regulation means.

65. An installation according to claim 56 wherein the ventilation and air-conditioning means of each module have a respective motor fan adjoining the respective air blowing connector, and wherein each module has means for mounting and dismounting the motor fan accessible through a front peripheral face of said module.

66. An installation according to claim 65 wherein the motor fan of each module constitutes a structural unit with the respective air blowing connector and wherein each module comprises a front hatch on a front peripheral face adjoining the respective air blowing connector and detachable fastening means for said structural unit around and before said front hatch.

67. An installation according to claim 65 wherein the motor fan of each module is housed detachably inside the respective internal air circuit, and wherein each module has, facing said motor fan, a front hatch on a front peripheral face and a detachable front lid to close said front hatch.

68. An installation according to claim 62 wherein said heat exchanger of each module is of a heat-exchanging fluid circulation type, wherein the energy supply means have an inlet piping for heat-exchanging fluid and a return piping for heat-exchanging fluid common to all the air-processing modules and wherein the connection means to connect the ventilation and air-conditioning means of each module to energy supply means comprise two respective tubes to convey said heat-exchanging fluid, respectively connected to said inlet piping and to said return piping and placed so as to face a peripheral face of said module and a respective adjusting valve placed in one of said tubes, facing a front peripheral face of said module and connected to said respective adjustable regulation means.

69. An installation according to claim 50 and further comprising means to supply the air processing modules with fresh air, supply means including fresh air piping common to all the air-processing modules and wherein, for each module, there are respective means to connect the respective air suction connector with said fresh air piping, comprising respective fresh air flowrate regulating means.

70. An installation according to claim 50 wherein, each air-processing module is bounded externally by two mutually parallel, flat, lateral faces and by peripheral faces which connect said lateral faces to each other and group the supporting means of said module, said air suction and air blowing connectors, said connection means to energy supply means an access means to said ventilation and air-conditioning means, and wherein the modules are juxtaposed with each other by said flat lateral faces and wherein fresh air supply means including fresh air piping common to all the air-processing modules and wherein, for each module, there are respective means to connect said respective internal circuit with said fresh air piping, said respective connecting means being located on a peripheral face of the respective module and comprising respective fresh air flowrate regulating means.

71. An installation according to claim 50 wherein each air blowing opening comprises a thermostatic flap to orient the blow air according to the blowing temperature.

72. An installation according to claim 50 wherein the conduits have identical and constant sections.

73. An installation according to claim 4 wherein the conduits are flexible at least locally, inside the engine room.

74. An installation according to claim 50 wherein the means to connect the ventilation and air-conditioning means to energy supply are flexible, at least locally in the engine room.

75. An air-processing installation designed for the ventilation and air-conditioning of several rooms, and comprising, to this effect, air-processing means housed in an engine room, at least one air blowing opening and at least one air suction opening in each room and conduits to connect said air blowing and air suction opening to the air-processing means, wherein said air processing means comprise several air-processing modules grouped together in said engine room and wherein each module is associated with a respective room and comprises, independently of the other air-processing modules:

an air suction connector connected by a respective conduit to the air suction opening of the respectively associated room, air blowing connector connected to the air blowing openings of the respectively associated room by a respective conduit, an internal air circuit connecting said air suction and air blowing connectors to each other, ventilation and air-conditioning means interposed in said internal air circuit, means for connecting the ventilation and air-conditioning means to energy supply means, adjustable means to regulate the ventilation and air-conditioning means at least as regards air temperature, and wherein there are provided respective means for the remote control of the adjustable means for the regulation of the ventilation and air-conditioning means of each air-processing module from the respectively associated room; the ventilation and air-conditioning means of each module including a respective motor fan of a variable speed type connected to said, respective adjustable regulation

76. An air-processing module comprising:

an air suction connector capable of receiving an air suction conduit;

an air blowing connector capable of receiving an air blowing conduit;

an internal air circuit connecting said air suction an air blowing connectors to each other.

ventilation and air-conditioning means interposed in said internal air circuit;

adjustable and remote-controlled means for the regulation of the ventilation and air-conditioning means, at least in air temperature, said module being bounded externally by two flat, mutually parallel lateral faces and by peripheral faces which join said lateral faces together and which group supporting means for said module, said air suction and air blowing connectors, said means for connecting to energy supply means and means of access to said ventilation and air-conditioning means, said supporting means comprising means for suspension of said module in a suspension position wherein said lateral faces are oriented vertically, said air suction and air blowing connectors are turned upward in said suspension position, and wherein said internal air circuit of the module has the shape of a U between said air suction and air blowing connectors.

77. A module according to claim 76 wherein the ventilation and air-conditioning means comprise a filter and at least one heat exchanger which are mutually juxtaposed horizontally and are vertical in said position of suspension, and wherein said internal circuit comprises an inlet plenum chamber between said filter and the air suction connector, and an outlet plenum chamber between said heat exchanger and the air blowing connector.

78. A module according to claim 77 comprising vertical slides for the movable receiving of the filter, a lower hatch for the mounting and dismounting of the filter by sliding it in said vertical slides on a lower peripheral face of the module, and a detachable lower lid to close said lower hatch, referring to its suspended position.

79. A module according to claim 77 comprising vertical slides for the movable receiving of the heat exchanger, an upper hatch for the mounting and dismounting of the exchanger by sliding it in said vertical slides on an upper peripheral face of the module, between said air suction and air blowing connectors, and a detachable upper lid to close said upper hatch, and wherein the means for connecting the ventilation and air-conditioning means to the energy supply means are connected to the heat exchanger at the upper detachable lid, referring to said suspended position.

80. A module according to claim 77 wherein said heat exchanger of each module is of a heat-exchanging fluid circulation type and wherein the means for connecting the ventilation and air-conditioning system to the energy supply means comprise two tubes, for the inlet and return, respectively, of said heat-exchanging fluid, placed so as to face a peripheral face of said module and a respective adjusting valve placed in one of said tubes, facing a front peripheral face of said module, referring to the position of suspension, and connected to said respective adjustable regulation means.

81. A module according to claim 76 wherein the ventilation and air-conditioning means comprise a filter and at least one heat exchanger which are horizontal and are mutually juxtaposed horizontally in said position of suspension, and wherein said internal air circuit comprises an inlet plenum chamber between said filter, above it, and the air suction connector, an intermediate plenum chamber beneath said filter and said heat exchanger, and an output plenum between said heat exchanger, above it, and the air blowing connector, referring to said position of suspension.

82. A module according to claim 81 comprising a movable cradle to receive the filter, a lower hatch for the dismounting of said filter on a lower peripheral face of said module, and a detachable lower lid to close said lower hatch bearing said cradle, referring to the position of suspension.

83. A module according to claim 81 wherein said heat exchanger of each module is of a heat-exchanging fluid circulation type and wherein the means for connecting the ventilation and air-conditioning system to the energy supply means comprise two tubes, for the inlet and return, respectively, of said heat-exchanging fluid, placed so as to face a peripheral face of said module and a respective adjusting valve placed in one of said tubes, facing a front peripheral face of said module, referring to the position of suspension, and connected to said respective adjustable regulation means.

84. A module according to claim 76 wherein the ventilation and air-conditioning means comprise a motor fan adjoining the air blowing connector, and comprise means for mounting and dismounting the motor fan accessible through a front peripheral face of the module, referring to the position of suspension.

85. A module according to claim 84 wherein the motor fan constitutes a structural unit with the air blowing connector and wherein the module comprises a front hatch on said front peripheral face adjoining the air blowing connector and means for the detachable fixing of said structural unit around and before said front hatch.

86. A module according to claim 84 wherein the motor fan is housed detachably inside said internal air circuit, and wherein the module has, facing said motor fan, a front hatch on said front peripheral face and a detachable front lid to close said front hatch.

87. An air-processing module comprising:

an air suction connector capable of receiving an air suction conduit;

an air blowing connector capable of receiving an air blowing conduit;

an internal air circuit connecting said air suction an air blowing connectors to each other, ventilation and air-conditioning means interposed in said internal air circuit;

adjustable and remote-controlled means for the regulation of the ventilation and air-conditioning means, at least in air temperature, said module being bounded externally by two flat, mutually parallel lateral faces and by peripheral faces which join said lateral faces together and which group supporting means for said module, said air suction and air blowing connectors, said means for connection to energy supply means and means of access to said ventilation and air-conditioning means, said supporting means comprising means for the suspension of said module in a suspension position such that said flat lateral faces are oriented vertically, said suspension means are located in an upper peripheral zone of the said module, vertical to the center of gravity of the module in said position of suspension.

88. A module according to claim 87 wherein the ventilation and air-conditioning means comprise a variable speed motor fan connected to said adjustable regulation means.

89. A module according to claim 87 comprising a connector that links said internal air circuit with a fresh air piping arranged on a peripheral face.

90. A module according to claim 89 wherein said linking connector comprises flowrate regulating means.

91. An air-processing module comprising:

an air suction connector capable of receiving an air suction conduit;

an air blowing connector capable of receiving an air blowing conduit;

an internal air circuit connecting said air suction an air blowing connectors to each other, ventilation and air-conditioning means interposed in said internal air circuit;

adjustable and remote-controlled means for the regulation of the ventilation and air-conditioning means, at least in air temperature, said module being bounded externally by two flat, mutually parallel lateral faces and by peripheral faces which join said lateral faces together and which group supporting means for said module, said air suction and air blowing connectors, said means for connection to energy supply means and means of access to said ventilation and air-conditioning means, said supporting means comprising means for the suspension of said module in a suspension position wherein said flat lateral faces are oriented vertically, said suspension means comprise an intermediate chamber for connection between said air suction and air blowing connectors, on the one hand, and the respective, corresponding conduits on the other, and means to join said intermediate chamber detachably to the module on a peripheral face of the module.

92. A module according to claim 91 wherein the intermediate chamber has two external lateral faces forming a coplanar extension of said lateral faces of the module, and peripheral faces assembling means for connection with air suction and blowing conduits, means for detachable joining with the module and means for the suspension of the intermediate chamber.

* * * * *